US011987981B2

(12) United States Patent
Saadatmanesh et al.

(10) Patent No.: US 11,987,981 B2
(45) **Date of Patent: *May 21, 2024**

(54) STRUCTURAL ELEMENT REINFORCEMENT SYSTEMS AND METHODS

(71) Applicant: CARBOSHIELD, INC., Tucson, AZ (US)

(72) Inventors: Hamid Saadatmanesh, Tucson, AZ (US); Ehsan Mahmoudabadi, Tucson, AZ (US)

(73) Assignee: CARBOSHIELD, INC., Tucson, AZ (US)

( * ) Notice: Subject to any disclaimer, the term of this patent is extended or adjusted under 35 U.S.C. 154(b) by 136 days.

This patent is subject to a terminal disclaimer.

(21) Appl. No.: 17/473,743

(22) Filed: Sep. 13, 2021

(65) Prior Publication Data

US 2022/0042311 A1 Feb. 10, 2022

Related U.S. Application Data

(63) Continuation-in-part of application No. 16/884,585, filed on May 27, 2020, now Pat. No. 11,118,364,
(Continued)

(51) Int. Cl.
*E04C 3/00* (2006.01)
*E04C 3/34* (2006.01)
(Continued)

(52) U.S. Cl.
CPC ..... *E04C 3/34* (2013.01); *E04C 3/36* (2013.01); *E04C 5/07* (2013.01); *E04G 23/0225* (2013.01); *E04G 2023/0251* (2013.01)

(58) Field of Classification Search
CPC ..... B29C 48/21; B29C 48/09; B29C 48/151; B29C 48/15; E04G 23/0225;
(Continued)

(56) References Cited

U.S. PATENT DOCUMENTS 1,947,413 A 2/1934 Hay
2,897,553 A 8/1959 Gorrow
(Continued)

FOREIGN PATENT DOCUMENTS

EP 0572243 A1 12/1993
WO WO1995023898 A1 9/1995
(Continued)

OTHER PUBLICATIONS

International Search Report for WO Application No. PCT/US2017/044378 dated Oct. 30, 2017, 4 pages.
(Continued)

*Primary Examiner* — Chi Q Nguyen
(74) *Attorney, Agent, or Firm* — NGUYEN TARBET LLC

(57) ABSTRACT

Systems for reinforcement of structural elements such as piles, posts, pillars, and pipes are disclosed. The present invention features reinforced structural elements. The reinforced structural elements may include a sleeve structure positioned around a length of the structural element such that there is a chamber between the structural element and the sleeve structure. This chamber may be filled with concrete or another core filler material so as to reinforce the structural element. The sleeve structures of the present invention may be formed by the assembly of multiple staggered segmented layers of coupled reinforcing shells such as rigid, semi-rigid, or flexible fiber-reinforced shells.

20 Claims, 22 Drawing Sheets

Related U.S. Application Data which is a continuation-in-part of application No. 16/321,163, filed as application No. PCT/US2017/044378 on Jul. 28, 2017, now Pat. No. 10,689,868.

(60) Provisional application No. 62/367,762, filed on Jul. 28, 2016.

(51) Int. Cl.
*E04C 3/36* (2006.01)
*E04C 5/07* (2006.01)
*E04G 23/02* (2006.01)

(58) Field of Classification Search
CPC ..... E04G 2023/0251; E04H 12/2292; E04C 5/073; E04C 5/07; E04C 3/30; E04C 3/34; E04C 3/36
See application file for complete search history.

(56) References Cited

U.S. PATENT DOCUMENTS

| | | | | |
|---|---|---|---|---|
| 3,963,546 | A | 6/1976 | Roberti | |
| 4,019,301 | A | 4/1977 | Fox | |
| 4,116,013 | A | 9/1978 | Hellmers | |
| 4,244,156 | A | 1/1981 | Watts, Jr. | |
| 4,439,071 | A | 3/1984 | Roper, Jr. | |
| 4,694,622 | A | 9/1987 | Richard | |
| 4,993,876 | A | 2/1991 | Snow et al. | |
| 5,398,461 | A | 3/1995 | Rose | |
| 5,458,683 | A | 10/1995 | Taylor et al. | |
| 5,505,030 | A | 4/1996 | Michacewiz et al. | |
| 5,513,477 | A | 5/1996 | Farber | |
| 5,640,825 | A | 6/1997 | Ehsani et al. | |
| 5,694,734 | A | 12/1997 | Cercone et al. | |
| 5,996,521 | A | 12/1999 | Kitano et al. | |
| 6,123,485 | A * | 9/2000 | Mirmiran | E04C 3/29 405/232 |
| 6,224,294 | B1 | 5/2001 | Mansfield | |
| 6,379,085 | B1 | 4/2002 | Vanderklaauw | |
| 6,382,878 | B1 | 5/2002 | Yang | |
| 6,519,909 | B1 | 2/2003 | Fawley | |
| 6,753,340 | B2 | 6/2004 | Vergne et al. | |
| 7,780,375 | B1 | 8/2010 | Khachaturian et al. | |
| 8,281,545 | B2 * | 10/2012 | Choi | E04C 3/34 52/847 |
| 8,341,860 | B2 * | 1/2013 | Boyce | B29C 70/207 428/36.1 |
| 8,353,643 | B2 | 1/2013 | Khachaturian et al. | |
| 8,465,228 | B2 | 6/2013 | Doleshal | |
| 8,628,275 | B1 | 1/2014 | Trader et al. | |
| 8,650,831 | B2 | 2/2014 | Ehsani | |
| 9,038,353 | B2 | 5/2015 | Huncovsky | |
| 9,890,546 | B2 | 2/2018 | Ehsani | |
| 10,119,238 | B2 * | 11/2018 | Doudican | E02D 5/64 |
| 10,619,321 | B2 | 4/2020 | Hess et al. | |
| 10,689,868 | B2 | 6/2020 | Saadatmanesh et al. | |
| 11,118,364 | B2 | 9/2021 | Saadatmanesh et al. | |
| 11,427,976 | B2 * | 8/2022 | Ustach | E01F 13/00 |
| 2004/0074199 | A1 | 4/2004 | Gordin et al. | |
| 2004/0048022 | A1 | 6/2004 | Pratt | |
| 2004/0202511 | A1 | 10/2004 | Bae | |
| 2004/0211148 | A1 * | 10/2004 | Foust | E04H 12/085 52/831 |
| 2008/0017263 | A1 * | 1/2008 | Robinson | B29C 70/342 138/97 |
| 2009/0165404 | A1 | 7/2009 | Choi | |
| 2015/0159387 | A1 | 6/2015 | Chou et al. | |
| 2015/0183170 | A1 * | 7/2015 | Ehsani | F16L 57/02 156/185 |
| 2015/0190972 | A1 * | 7/2015 | Ehsani | B29C 73/34 156/475 |
| 2016/0060892 | A1 | 3/2016 | Odegard et al. | |
| 2016/0076249 | A1 * | 3/2016 | Gibson | B29C 70/52 264/171.12 |
| 2016/0145882 | A1 * | 5/2016 | Ehsani | E04G 23/0225 52/741.3 |
| 2019/0264409 | A1 | 8/2019 | Hess et al. | |
| 2022/0098814 | A1 * | 3/2022 | Zong | E02D 5/30 |
| 2022/0259876 | A1 * | 8/2022 | Secrest | E04B 2/16 |

FOREIGN PATENT DOCUMENTS

| | | | |
|---|---|---|---|
| WO | WO2006032033 | A2 | 3/2006 |
| WO | 2016007503 | A1 | 1/2016 |

OTHER PUBLICATIONS

Hoff, G. W. "Strong medicine. Fiber-reinforced polymer materials can help cure many ills that beset concrete." Concrete Construction (2000): 40-47.

* cited by examiner

STRUCTURAL ELEMENT REINFORCEMENT SYSTEMS AND METHODS

CROSS-REFERENCES TO RELATED APPLICATIONS

This application is a continuation-in-part and claims benefit of U.S. patent application Ser. No. 16/884,585, filed May 27, 2020, now U.S. Pat. No. 11,118,364, which is a continuation-in-part and claims benefit of U.S. patent application Ser. No. 16/321,163, filed Jan. 28, 2019, now U.S. Pat. No. 10,689,868, which is a 371 Application of PCT/US2017/044378, filed on Jul. 28, 2017, which claims priority to U.S. Provisional Application No. 62/367,762, filed on Jul. 28, 2016, the specifications of which are incorporated herein in their entirety by reference.

BACKGROUND OF THE INVENTION

Field of the Invention

The present invention generally relates to the reinforcement of structural elements. More specifically, the present invention relates to the reinforcement of structural elements with sleeve structures formed by reinforcing shells.

Background Art

Fiber-reinforced polymers have become frequently used in structural engineering applications due to their inherent cost-effectiveness in a number of field applications, including those involving structural materials including concrete, masonry, steel, cast iron, and wood. Fiber-reinforced polymers can be used in industry for retrofitting to strengthen an existing structure and/or as an alternative reinforcing (or pre-stressing) material instead of conventional materials from the outset of a project. Recently, retrofitting has become a dominant industrial use of fiber-reinforced polymers, with applications including increasing the load capacity of old structures, such as bridges, which were designed with much lower service load tolerances than are typically required today. Other uses include seismic retrofitting and repairing damaged structures.

Applied to reinforced concrete structures for flexure, fiber-reinforced polymers typically have a large effect on strength, but only provide a moderate increase in stiffness of the reinforced concrete structures. This is thought to be due to the high strength, but low stiffness, of relatively thin fiber-reinforced polymer cross-sections. Consequently, however, only small cross-sectional areas of the fiber-reinforced polymers are typically used. Likewise, small areas of fiber-reinforced polymer having very high strength but moderate stiffness applied to a section of a reinforced concrete structure will significantly increase the strength, but to a lesser degree, the stiffness of the reinforced concrete structure.

BRIEF SUMMARY OF THE INVENTION

It is an objective of the present invention to provide systems, devices and methods that allow for reinforcement of structural elements, as specified in the independent claims. Embodiments of the invention are given in the dependent claims. Embodiments of the present invention can be freely combined with each other if they are not mutually exclusive.

The reinforcement of a structural element may be accomplished by a system which includes a sleeve structure to surround a length of the structural element and a core filler material to fill a chamber between the structural element and the sleeve structure. The sleeve structure may be constructed in segments via the attachment of reinforcing shells so that the entire sleeve structure may be assembled from a single point and maneuvered into position as the length of the sleeve structure is extended.

One of the unique and inventive technical features of the present invention is the use of multiple segmented layers to form the sleeve structure. Without wishing to limit the invention to any theory or mechanism, it is believed that the technical feature of the present invention advantageously provides for a sleeve structure with staggered vertical and horizontal seams and high strength. None of the presently known prior references or work has the unique inventive technical feature of the present invention.

The present invention additionally provides a method of reinforcing a structural element. The structural element extends for a distance along an axis between first and second ends and presents an external surface. The method comprises (i) positioning a first rigid, semi-rigid, or flexible fiber-reinforced shell extending between first and second edges partially about the external surface of the structural element to leave an exposed portion of the structural element. The method further comprises (ii) positioning a second rigid, semi-rigid, or flexible fiber-reinforced shell extending between first and second edges about the exposed portion of the structural element such that the first edge of the second rigid, semi-rigid, or flexible fiber-reinforced shell is adjacent the first edge of the first rigid, semi-rigid, or flexible fiber-reinforced shell to give a first seam and the second edge of the second rigid, semi-rigid, or flexible fiber-reinforced shell is adjacent the second edge of the first rigid, semi-rigid, or flexible fiber-reinforced shell to give a second seam, thereby enveloping at least a portion of the structural element. Finally, the method comprises (iii) adhering the first and second rigid, semi-rigid, or flexible fiber-reinforced shells to the structural element. A reinforced structural element formed in accordance with the method is also provided.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE SEVERAL VIEWS OF THE DRAWINGS

The features and advantages of the present invention will become apparent from a consideration of the following detailed description presented in connection with the accompanying drawings in which:

FIG. 17A shows a repeating sequence of three segments, each made of two partial-diameter shells, with each segment attached to two axial reinforcing members.

FIG. 17B shows a repeating sequence of four segments, each made of two partial-diameter shells, with each segment attached to four axial reinforcing members.

FIG. 17C shows a repeating sequence of four segments, each made of two partial-diameter shells, with each segment attached to eight axial reinforcing members.

FIG. 17D shows a repeating sequence of four segments, each made of two partial-diameter shells, with each segment attached to four of eight axial reinforcing members.

FIG. 17E shows a repeating sequence of four segments, each made of two partial-diameter shells, with every other segment attached to eight axial reinforcing members.

FIG. 17F shows a repeating sequence of four segments, each made of two partial-diameter shells, with every other segment attached to four of eight axial reinforcing members.

FIG. 17G shows a repeating sequence of four segments, each made of two partial-diameter shells, with each segment attached to two of eight axial reinforcing members.

FIG. 17H shows a repeating sequence of two segments, each made of three partial-diameter shells, with each segment attached to two reinforcing members.

FIG. 17I shows a repeating sequence of two segments, each made of four partial-diameter shells, with each segment attached to four reinforcing members.

DETAILED DESCRIPTION OF THE INVENTION

Figure 1:
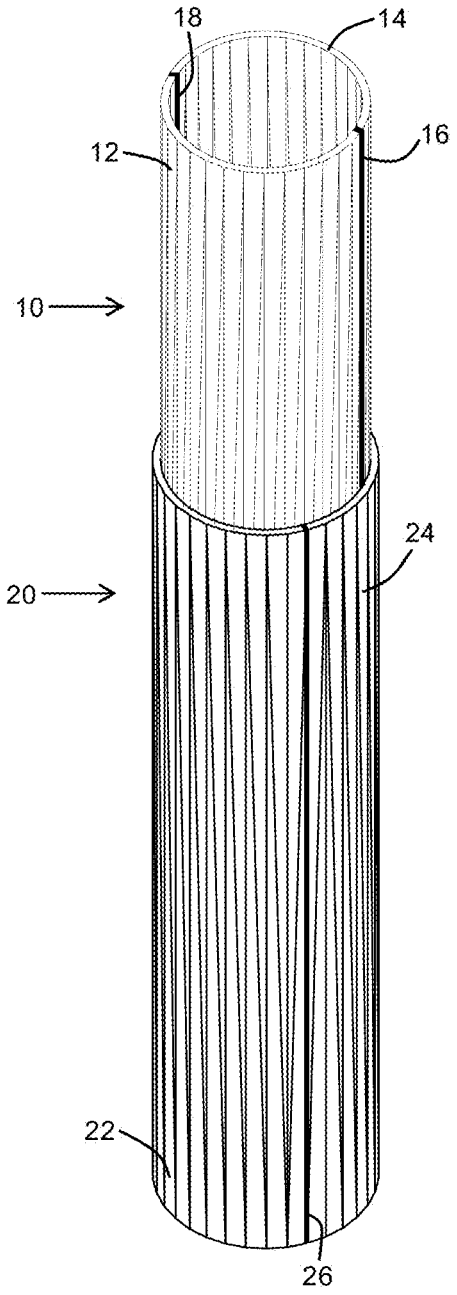
FIG. 1 shows a first pair of rigid, semi-rigid, or flexible fiber-reinforced shells and a second pair of rigid, semi-rigid, or flexible fiber-reinforced shells disposed about the first pair of rigid, semi-rigid, or flexible fiber-reinforced shells.

Following is a list of elements corresponding to a particular element referred to herein:

1 Reinforced structural element
2 Structural element
10 First pair of rigid, semi-rigid, or flexible fiber-reinforced shells
12 First rigid, semi-rigid, or flexible fiber-reinforced shell
14 Second rigid, semi-rigid, or flexible fiber-reinforced shell
16 First seam
18 Second seam
20 Second pair of rigid, semi-rigid, or flexible fiber-reinforced shells
22 Third rigid, semi-rigid, or flexible fiber-reinforced shell
24 Fourth rigid, semi-rigid, or flexible fiber-reinforced shell
26 Third seam
210 Third pair of rigid, semi-rigid, or flexible fiber-reinforced shells
212 Fifth rigid, semi-rigid, or flexible fiber-reinforced shell
214 Sixth rigid, semi-rigid, or flexible fiber-reinforced shell
216 Fifth seam
218 Sixth seam
220 Fourth pair of rigid, semi-rigid, or flexible fiber-reinforced shells
222 Seventh rigid, semi-rigid, or flexible fiber-reinforced shell
224 Eighth rigid, semi-rigid, or flexible fiber-reinforced shell
228 Eighth seam
310 Fifth pair of rigid, semi-rigid, or flexible fiber-reinforced shells
312 Ninth rigid, semi-rigid, or flexible fiber-reinforced shell
314 Tenth rigid, semi-rigid, or flexible fiber-reinforced shell
316 Ninth seam
318 Tenth seam
320 Sixth pair of rigid, semi-rigid, or flexible fiber-reinforced shells
322 Eleventh rigid, semi-rigid, or flexible fiber-reinforced shell
324 Twelfth rigid, semi-rigid, or flexible fiber-reinforced shell
328 Twelfth seam
400 Reinforced structural element

402 Structural element
404 Axis
405 Length
406 Chamber
408 Surface
410 Sleeve structure
412 First segmented layer
414 Second segmented layer
416 Segment
417 Diameter
418 Horizontal seams
420 Reinforcing shells
422 Interior surface
424 Vertical seams
426 Core filler material
428 Shell adhesive
430 Wrapped layer
440 Axial reinforcing member
441 Axial reinforcing member connector
442 Axial reinforcing member spacer
450 Shear key
452 Shear key protrusion
454 Spacer
456 Spacer spring
458 Spacer roller
460 Annular space
470 Bottom seal
472 Bottom seal fastener As used herein, the terms "vertical" and "horizontal" refer to orientation relative to the axis of the structural element, where a vertical orientation is parallel with the axis and a horizontal orientation is perpendicular to the axis. The axis of the structural element may be in any orientation. For example, the structural element may be a vertical or a horizontal structural element. The structural element may be a bridge pile, a post, a support pipe, a gas or water pipe, an electrical conduit, a column or any other structural element.

In one embodiment, the present invention features a reinforced structural element (400). The reinforced structural element (400) may comprise: a structural element (402) extending along an axis (404); a sleeve structure (410) disposed around a length (412) of the structural element (402) such that there is a chamber (406) between the structural element (402) and the sleeve structure (410); and a core filler material (426) disposed within the chamber (406) between the sleeve structure (410) and the structural element (402) so as to reinforce the structural element (402). In some embodiments, the chamber (406) may have a cross-sectional area which is significantly larger than a cross-sectional area of the structural element (402). As a non-limiting example, the chamber (406) may have a cross-sectional area which is 5, 10, 15, 20, 25, 30, 40, 50, 60, 70, 80, 90, 100, 120, 140, 160, 180, 200, 250, 300, 400, 500, 600, 700, 800, 900, 1000, or greater than 1000 percent larger than a cross-sectional area of the structural element (402).

Without wishing to limit the present invention to any particular theory or mechanism, it is believed that it is advantageous in certain situations to have a significant chamber (406) between the structural element (402) and the sleeve structure (410) because it provides area for reinforcing core filler material (426) and also allows the sleeve structure (410) to be freely slid along the structural element (402) without catching on the structural element (402) even if there are irregularities on the surface of the structural element (402). Additionally, the space between the structural element (402) and the sleeve structure (410) may advantageously allow for the introduction of axial reinforcing members (440) or horizontal rebar. In some embodiments, the core filler material (426) may comprise an adhesive material. As a non-limiting example, the core filler material (426) may comprise a cement, a polymer cement, a glue, a resin, a polymer, or a foam.

According to some preferred embodiments, the sleeve structure (410) may comprise multiple concentric layers. These layers may be rigid, semi-rigid, or flexible. As a non-limiting example, the sleeve structure may comprise: a first segmented layer (412), comprising a plurality of stacked segments (416) which each surround the structural element (402) and a plurality of horizontal seams (418) between the segments (416), the segments (416) disposed along the axis (404), wherein each segment (416) comprises two or more reinforcing shells (420) and two or more vertical seams (424) between the reinforcing shells (420); and a second segmented layer (414), comprising a plurality of stacked segments (416) which each surround the first segmented layer (412) and a plurality of horizontal seams (418) between the segments (416), the segments (416) disposed along the axis (404), wherein each segment (416) comprises two or more reinforcing shells (420) and two or more vertical seams (424) between the reinforcing shells (420).

In some embodiments, the sleeve structure (410) may comprise a single layer of segments (416) with overlapping joints. As one non-limiting example, instead of forming the segments (416) of the sleeve structure (410) by joining multiple reinforcing shells (420) together, each segment (416) may be formed by folding a single flexible or semi-rigid plate into a cylindrical shape with a single overlapped vertical seam (424). The width of the overlap for the overlapped seam may depend on the thickness of the single flexible or semi-rigid plate. These segments (416) may then be stacked vertically with overlapping horizontal seams (418). For example, each segment (416) may have a top diameter which is larger or smaller than the bottom diameter such that each segment fits partially within one adjacent segment and partially around another adjacent segment. Where other embodiments, may have multiple vertical seams (424) in each segment (416), this embodiment may have only a single vertical seam (424) in each segment (416), thus reducing the amount of work required to install the reinforcement.

In some embodiments the reinforcing shells (420) may comprise fiber-reinforced shells. As a non-limiting example, the reinforcing shells (420) may comprise carbon fiber/epoxy composite shells. In other embodiments, the reinforcing shells (420) may comprise metal, ceramic, polymer, cardboard, or another structural material. In some embodiments, the reinforcing shells (420) may be solid. In other embodiments, the reinforcing shells (420) may have holes or pores and may require coating with another layer so as to prevent core filler material (426) from escaping through the holes or pores. In some embodiments, the reinforcing shells (420) may be rigid. In other embodiments, the reinforcing shells (420) may be flexible, or may be flexible prior to hardening and rigid after hardening.

According to some embodiments, the sleeve structure (410) may additionally comprise one or more wrapped layers (430), each wrapped layer (430) formed by wrapping a flexible reinforcing material around one of the segmented layers or another of the wrapped layers (430). For example, sleeve structure (410) may comprise one or more segmented layers formed of reinforcing shells (420) which have one or more wrapped layers (430) surrounding them as a final reinforcement layer. As a non-limiting example, the flexible reinforcing material may be wrapped in a helical or a circumferential pattern. For added strength, multiple layers of the flexible reinforcing material may be wrapped in alternating helical patterns. In some embodiments, the flexible material may be coated or impregnated with a curable material so as to allow it to cure and harden. In other embodiments, additional segmented layers may be placed over the wrapped layers (430) so as to sandwich the wrapped layers (430) between segmented layers.

In some embodiments, the reinforced structural element (400) may additionally comprise axial reinforcing members (440). In some embodiments, the axial reinforcing members (440) may be disposed within the chamber (406) and encapsulated within the core filler material (426). In other embodiments, the axial reinforcing members (440) may be disposed within the layers of the sleeve structure (410) or on the exterior of the sleeve structure (410). As non-limiting examples the axial reinforcing members (440) may comprise rigid, semi-rigid, or flexible rods, rigid, semi-rigid, or flexible bars, chains, springs, rebar, or cables. The axial reinforcing members (440) may comprise metal, polymer, ceramic, fibrous material, cord, or another structural material. The axial reinforcing members (440) may be oriented parallel or perpendicular to the axis (404) in straight, non-straight, spiral, or other configurations. In some embodiments, the axial reinforcing members (440) may be formed by coupled axial reinforcing segments. As a non-limiting example, the axial reinforcing segments may be rebar rods which are coupled with screw couplers so as to form long axial reinforcing members (440). Without wishing to limit the present invention to any particular theory or mechanism, it is believed that using axial reinforcing members (440) which are made up of axial reinforcing segments may allow for easy installation of the axial reinforcing members (440), one or more segments at a time.

In some embodiments, the axial reinforcing members (440) may be attached directly to the reinforcing shells (420). In other embodiments, the axial reinforcing members (440) may be positioned within the chamber (406) so as to avoid touching the reinforcing shells (420). The axial reinforcing members (440) may be positioned prior to positioning of the reinforcing shells (420) or may be inserted into the chamber (406) after the reinforcing shells (420) are positioned. Alternatively, the reinforcing shells (420) and the axial reinforcing members (440) may be assembled simultaneously. In some embodiments, the axial reinforcing members (440) may act as a guide to allow for the reinforcing shells (420) to be slid into position along the structural element (402). In another embodiment, the axial reinforcing members (440) may be directly wrapped with one or more wrapped layers (430) so as to form a sleeve structure (410) without the use of reinforcing shells (420).

As a non-limiting example, a system of the present invention for reinforcing a structural element (402) may include a plurality of axial reinforcing members (440) configured to be disposed within the chamber (406) so as to provide axial reinforcement of the structural element (402) and a plurality of axial reinforcing member spacers (442) configured to extend inwardly from the sleeve structure (410) into the chamber (406) and to connect the axial reinforcing members (440) to the sleeve structure (410). Without wishing to limit the present invention to any particular theory or mechanism, it is believed that attaching the axial reinforcing members (440) to the sleeve structure (410) via axial reinforcing member spacers (442) may advantageously position the axial reinforcing members (440) midway between the sleeve structure (410) and the structural element (402) so to provide strong mechanical interlock between the sleeve structure (410) and the core filler material (426).

In some embodiments, the plurality of axial reinforcing members (440) comprises N axial reinforcing members, disposed around the structural element (402) about every 360/N degrees. In other embodiments, the axial reinforcing members (440) may have a non-uniform angular distribution. In some embodiments, the plurality of axial reinforcing members (440) may be arranged in the shape of a single ring around the structural element (402). In other embodiments, the plurality of axial reinforcing members (440) may be arranged in the shape of a double or triple ring around the structural element (402). Thus, each of the axial reinforcing members (440) may have the same or different spacing from the surface of the structural element (402).

In some embodiments, each of the plurality of axial reinforcing members (440) are segmented. In other embodiments, some or all of the plurality of axial reinforcing members (440) are non-segmented. In some embodiments, a segment of the axial reinforcing members (440) may have a length about equal to a height of an integer number of the plurality of stacked segments (416). As non-limiting examples, a segment of the axial reinforcing members (440) may have a length about equal to the height of 1, 2, 3, 4, 5, 6, 7, 8, 9, 10, or more stacked segments (416). In some embodiments, the axial reinforcing members (440) may be vertically aligned with the sleeve structure (410) such that the ends of each segment of the axial reinforcing members (440) are at about the same height as the horizontal seams (418) between the segments (416). In other embodiments, the axial reinforcing members (440) may be vertically aligned with the sleeve structure (410) such that the ends of each segment of the axial reinforcing members (440) are positioned between the horizontal seams (418). In still other embodiments, the segments of the axial reinforcing members (440) may be vertically staggered such that the ends of the segments of the various axial reinforcing members (440) are not aligned with each other. In some embodiments, the segments of the axial reinforcing members (440) may be joined via axial reinforcement member connectors (441) such as screw couplers, hook and eye couplers, wire ties, plastic clips, welding, or any other suitable connection mechanism.

In some embodiments, the axial reinforcing members (440) may be configured to support the sleeve structure (410) as it is lowered around the structural element (402). As a non-limiting example, the present invention may feature a method of reinforcing a structural element (402) including: positioning a lowering apparatus near the structural element (402) above the length of the structural element in need of reinforcement, connecting a plurality of axial reinforcing members (440) to the lowering apparatus via two or more flexible support members (822), attaching a plurality of rigid or semi-rigid reinforcing partial-diameter shells (420) to the axial reinforcing members (440) via a plurality of axial reinforcing member spacers (442) so as to form a sleeve structure (410) surrounding the structural element (402), and lowering the axial reinforcing members (440) and sleeve structure (410) via the lowering apparatus while they are being assembled in a segmented fashion.

In some embodiments, the axial reinforcing member spacers (442) may be rigid, and configured to hold the axial reinforcing members (440) at a spacer distance from an interior surface of one of the rigid or semi-rigid reinforcing partial-diameter shells (420). In some embodiments, each of the plurality of axial reinforcing member spacers (442) may include a u-shaped clip configured to snap around an axial reinforcing member (440). In other embodiments, the axial reinforcing member spacers (442) may include rigid or flexible loops for insertion of the axial reinforcing members (440). In embodiments where the axial reinforcing member spacers (442) are flexible, the axial reinforcing members (440) may be held in place relative to each other via circular reinforcing hoops, or by additional spacing clips attached to multiple axial reinforcing members (440). The axial reinforcing member spacers (442) may be formed from any suitable material. Non-limiting examples of materials which may be suitable for the axial reinforcing member spacers (442) include metal, plastic, cable, and composite materials.

According to some preferred embodiments, each of the plurality of axial reinforcing member spacers (442) may be attached to an interior surface of one of the rigid or semi-rigid reinforcing partial-diameter shells (420). In other embodiments, some or all of the plurality of axial reinforcing member spacers (442) may be attached to the structural element (402). In some embodiments, each of the plurality of axial reinforcing member spacers (442) may be attached to an interior surface of one of the rigid or semi-rigid reinforcing partial-diameter shells (420) via an adhesive, screws, rivets, a slotted connection, or any other suitable connection mechanism.

In some embodiments, each of the rigid or semi-rigid reinforcing partial-diameter shells (420) may be directly attached to one or more of the axial reinforcing member spacers (442). In other embodiments, only a fraction (e.g. ½, ⅓, ¼, ⅕, ⅙, ⅐, ⅛, 1/10, 1/20, 1/50, 1/100) of the rigid or semi-rigid reinforcing partial-diameter shells (420) may be directly attached to one or more of the axial reinforcing member spacers (442). In some embodiments, each stacked segment (416) of the first segmented layer (412) may be connected to one or more, or each of the axial reinforcing members (440) via one or more axial reinforcing member spacers (442). In other embodiments only a fraction (e.g. ½, ⅓, ¼, ⅕, ⅙, ⅐, ⅛, 1/10, 1/20, 1/50, 1/100) of the stacked segments (416) of the first segmented layer (412) may connected to one or more, or each of the axial reinforcing members (440) via one or more axial reinforcing member spacers (442).

In some embodiments, each of the plurality of axial reinforcing member spacers (442) may be attached to an interior surface of one of the rigid or semi-rigid reinforcing partial-diameter shells (420) at an angular distance from the vertical seams (424). Each of the plurality of axial reinforcing member spacers (442) may be attached at a same angular distance from the vertical seams (424), or the plurality of axial reinforcing member spacers (442) may be attached at different angular distances from the vertical seams (424). In some embodiments, the angular distances may be such that the vertical seams (424) of adjacent segments (416) are either aligned or staggered. As one non-limiting example, two adjacent segments (416) with an identical pattern of axial reinforcing member spacers (442) may be staggered by the angular distance between two adjacent axial reinforcing members (440). In some embodiments, the axial reinforcing members (440) may be vertical rods which are connected via circular reinforcing hoops, or by additional spacing clips attached to multiple axial reinforcing members (440).

In some embodiments, the connection between the axial reinforcing member spacers (442) and the axial reinforcing members (440) may be a fixed connection. In other embodiments, the connection between the axial reinforcing member spacers (442) and the axial reinforcing members (440) may be such that the axial reinforcing member spacers (442) may slide along the axial reinforcing members (440). As a non-limiting example, this may allow for the axial reinforcing members (440) to first be lowered around the structural element (402) and then used to guide sequential lowering of the sleeve structure (410). In some embodiments, a first plurality of axial reinforcing members (440) may be used to guide sequential lowering of the sleeve structure (410) as it is supported by a second plurality of axial reinforcing members (440) attached with fixed connections.

As a non-limiting example, a system of the present invention for reinforcing a structural element (402) may include: a sleeve structure (410) configured to surround a length (405) of the structural element (402) such that there is a chamber (406) between the structural element (402) and the sleeve structure (410); a plurality of axial reinforcing members (440) configured to be disposed within the chamber (406) so as to provide axial reinforcement of the structural element (402); a plurality of axial reinforcing member spacers (442) configured to extend inwardly from the sleeve structure (410) into the chamber (406) and to connect the axial reinforcing members (440) to the sleeve structure (410); and a core filler material (426) configured to fill the chamber (406) between the sleeve structure (410) and the structural element (402) so as to reinforce the structural element (402). In preferred embodiments, the sleeve structure (410) and the plurality of axial reinforcing members (440) may be configured to be lowered relative to the structural element (402).

As another non-limiting example, a system of the present invention for reinforcing a structural element (402) may include a sleeve structure (410) configured to surround a length (405) of the structural element (402) such that there is a chamber (406) between the structural element (402) and the sleeve structure (410); a plurality of axial reinforcing members (440) configured to be connected to the sleeve structure (410) so as to provide axial reinforcement of the structural element (402); and a core filler material (426) configured to fill the chamber (406) between the sleeve structure (410) and the structural element (402) so as to reinforce the structural element (402). The axial reinforcing members (440) may be segmented or unsegmented, and may be directly or indirectly connected to the sleeve structure (410). As a non-limiting example, the axial reinforcing members (440) may be connected to the sleeve structure (410) via an adhesive. In some embodiments, the sleeve structure may include vertical and/or horizontal grooves into which the axial reinforcing members (440) may be fit. In some embodiments, the grooves may be formed into an interior or exterior surface of rigid or semi-rigid reinforcing partial-diameter shells (420) which make up the sleeve structure (410). In some embodiments, a first segmented layer (412) may include grooves in an exterior surface which align with grooves in an interior surface of a second segmented layer (414) such that axial reinforcing members (440) fit within the grooves may be sandwiched between the first and second segmented layers.

As still another non-limiting example, a system of the present invention for reinforcing a structural element (402) may include: a plurality of reinforcing shells (420) configured to form a sleeve structure (410) around a length (405) of the structural element (402) such that there is a chamber (406) between the structural element (402) and the sleeve structure (410); one or more wrapped layers (430), each wrapped layer (430) formed by wrapping a flexible reinforcing material around one of the segmented layers or another of the wrapped layers (430); and a core filler material (426) configured to fill the chamber (406) between the sleeve structure (410) and the structural element (402) so as to reinforce the structural element (402). Furthermore the sleeve structure (410) may include: a first segmented layer (412), having a plurality of stacked segments (416) and a plurality of horizontal seams (418) between the segments (416), the segments (416) disposed along an axis (404), wherein each segment (416) has two or more rigid or semi-rigid reinforcing partial-diameter shells (420) and two or more vertical seams (424) between the rigid or semi-rigid reinforcing partial-diameter shells (420).

In some embodiments, a first wrapped layer (430) and a second wrapped layer (430) may be wrapped in opposite directions so as to produce a crossed pattern. In other embodiments, multiple wrapped layers (430) may be wrapped in the same direction. In some embodiments, a system including one or more wrapped layers (430) may also include a plurality of axial reinforcing members (440) configured to be disposed within the chamber (406) so as to provide axial reinforcement of the structural element (402); and a plurality of axial reinforcing member spacers (442) configured to extend inwardly from the sleeve structure (410) into the chamber (406) and to connect the axial reinforcing members (440) to the sleeve structure (410).

In one embodiment, the reinforced structural element (400) may additionally comprise a plurality of sheer keys (450), extending radially from a surface (408) of the structural element (400) and encapsulated by the core filler material (426). Without wishing to limit the present invention to any particular theory or mechanism, it is believed that these sheer keys (450) may improve the bonding between the structural element (402) and the core filler material (426) by providing a strong mechanical interlock. In preferred embodiments, the sheer keys (450) may be installed into the surface (408) of the structural element (400) prior to formation of the sleeve structure (410) around the structural element (400). As a non-limiting example, for underwater applications, the sheer keys (450) may be screwed into the surface (408) of a pile by a diver, before the sleeve structure (410) is lowered around the pile from above the waterline.

In another embodiment, the reinforcing shells (420) of the first segmented layer (412) may comprise shear key protrusions (452) extending from an interior surface (422) of the reinforcing shells (420) such that the shear key protrusions (452) are encapsulated by the core filler material (426). These shear key protrusions (452) may be formed by the same material of the reinforcing shells (420) or by another material. In one embodiment, the shear key protrusions (452) may pass through multiple layers of the sleeve structure (410). As a non-limiting example, after a portion or all of the sleeve structure (410) is assembled, a plurality of shear key protrusions (452) may be punched or screwed through the layers of the sleeve structure (410) to provide for mechanical interlock with the core filler material (426) and to physically attach the layers of the sleeve structure (410) together.

In preferred embodiments, each segment (416) may comprise n reinforcing shells (420) and n vertical seams (424), wherein n is an integer between 2 and 10. In other embodiments, n may be an integer between 10 and 1000. For example, when n is 2, each segment (416) may have two half-shells, with 180 degrees between the two seams. When n is 3, each segment (416) may have three third-shells, with 120 degrees between each of the three seams. When n is 4, each segment (416) may have four quarter-shells, with 90 degrees between each of the four seams.

According to preferred embodiments the vertical seams (424) of adjacent segments (416) may be staggered. The vertical seams (424) of adjacent segments (416) may be staggered so as to maximize the distance between adjacent vertical seams (424). In some embodiments, each consecutive segment (416) may be rotated by an offset angle with respect to the proceeding segment (416) so as to effectively stagger the vertical seams (424) for multiple segments (416). As a non-limiting example, if the offset angle is equal to the angle between the vertical seams (424) divided by an integer m, the vertical seams (424) would only repeat orientation every m segments (416). Additionally, the orientation of the segments (416) may be selected so that vertical seams (424) of adjacent segments (416) in different layers are also staggered so as to maximize the distance between adjacent vertical seams (424).

In some embodiments, the reinforcing shells (420) may form an end to end butt joint. In other embodiments, the reinforcing shells (420) may form a lap joint. The amount of overlap may depend on the thickness of the reinforcing shells (420).

Furthermore, in some embodiments, the horizontal seams (418) of the first (412) and second (414) segmented layers, or of additional adjacent layers, may be staggered. In some embodiments, horizontal seams (418) may be staggered by 1/L times the height of each segment (416) where L is an integer equal to the total number of segmented layers. For example, in an embodiment where the sleeve structure (410) has three segmented layers, the horizontal seams (418) of each layer may be staggered from the other two layers by $\frac{1}{3}^{rd}$ of the height of the segments. In order to accomplish this staggering, the layers may include offset segments with reinforcing shells (420) which have a different height from all the other reinforcing shells (420), for example, half height, third height, quarter height for two, three, and four layers respectively. As a non-limiting example, in an embodiment with five layers, the first layer may have no offset segment, the second layer may have a one-fifth height offset segment, the third a two-fifths offset segment, the fourth a three-fifths offset segment, and the fifth a four fifths offset segment, such that the horizontal seams (418) of all five layers would be offset from the horizontal seams (418) in every other layer.

In selected embodiments the sleeve structure (410) may comprise additional segmented layers, each layer comprising a plurality of stacked segments (416) and a plurality of horizontal seams (418) between the segments (416), the segments (416) disposed along the axis (404), wherein each segment (416) comprises two or more reinforcing shells (420) and two or more vertical seams (424) between the reinforcing shells (420). As a non-limiting example, the sleeve structure (410) may comprise 2, 3, 4, 5, 6, 7, 8, 9, 10, 11, 12, 13, 14, 15, 16, 17, 18, 19, 20 or more segmented layers.

In preferred embodiments the reinforcing shells (420) of each segment (416) may be adhesively or mechanically affixed together. Additionally, the reinforcing shells (420) of the first (412) and second (414) segmented layers may be adhesively or mechanically affixed together. For example, reinforcing shells (420) may be adhesively bound by a shell adhesive (428) such as a glue, a cement, a resin, a polymer, or another adhesive, bolted together, welded together, mechanically interlocked together, or affixed by any other adhesive or mechanical coupling. In one embodiment, an epoxy or adhesive may be pre-applied to the reinforcing shells (420) and covered with a peel-back cover paper. This peel-back cover paper can then be removed in the field just prior to pressing the reinforcing shells (420) together. In a further embodiment, some portions of the reinforcing shells (420) may have a curable adhesive underneath the peel-back cover paper and other portions of the reinforcing shells (420) may have a hardening agent underneath the peel-back cover paper such that when multiple reinforcing shells (420) are pressed together, the curable adhesive is placed in contact with the hardening agent.

In many embodiments, the structural element (402) may have a circular cross-section and the sleeve structure (410) may also have a circular cross-section. In other embodiments, the structural element (402) may have a non-circular cross-section. For example, the structural element (402) may have a rectangular cross-section. In these situations, the sleeve structure (410) may have a circular or a non-circular cross-section. As a non-limiting example, for the reinforcement of rectangular structural elements, a rectangular sleeve structure (410) may be used. This rectangular sleeve structure (410) may be formed by joining angled reinforcing shells (420) with multiple sides. The joints between the angled reinforcing shells (420) may be at a corner of the rectangular sleeve structure (410) or on one of the sides.

In one embodiment, the present invention features a system for reinforcing a structural element (402). As a non-limiting example, the system may comprise: a plurality of reinforcing shells (420) configured to form a sleeve structure (410) around a length (405) of the structural element (402) such that there is a chamber (406) between the structural element (402) and the sleeve structure (410), wherein the sleeve structure (410) comprises: a first segmented layer (412), comprising a plurality of stacked segments (416) and a plurality of horizontal seams (418) between the segments (416), the segments (416) disposed along an axis (404), wherein each segment (416) comprises two or more reinforcing shells (420) and two or more vertical seams (424) between the reinforcing shells (420); and a core filler material (426) configured to fill the chamber (406) between the sleeve structure (410) and the structural element (402) so as to reinforce the structural element (402). In one embodiment, the system may additionally comprise a shell adhesive (428) for affixing the reinforcing shells (420) together so as to form the sleeve structure (410).

In some embodiments, the system for reinforcing a structural element (402) may include one or more spacers (454) to hold the sleeve structure (410) in a desired orientation around the structural element (402) prior to the addition of the core filler material (426). For example, the spacers (454) may hold the sleeve structure (410) around the structural element (402) such that the two are co-axial or substantially co-axial. The spacers (454) may be positioned at one or both ends of the sleeve structure (410) and/or disposed along the inside of the sleeve structure. The spacers (454) may be attached to the structural element (402) prior to the installation of the sleeve structure (410) and may guide the initial positioning of the sleeve structure (410) around the structural element. As a non-limiting example, each spacer (454) may comprise a spacing rod having a set length which corresponds to the desired thickness of the annular space (460) of the chamber (406), such as half the difference between the diameter of the structural element (402) and the inner diameter of the sleeve structure (410). In some embodiments, each spacer (454) may be attached to either the structural element (402) or the sleeve structure (410) at one end, and comprise a spacer roller (458) at the other end, such that the spacers (454) may be used as the sleeve structure (410) is slid along the structural element (402). Additionally, the spacers (454) may be spring-loaded via the inclusion of a spacer spring (456), so as to account for surface roughness or imperfection of the structural element (402). In some embodiments, multiple spacers (454) may be used in a single position along the axis (404) so as to provide for three dimensional spacing. For example, three spacers (454) may be positioned around the structural element (402) at a single position along the axis with a radial spacing of 120°. As an alternative example a first set of two spacers (454) may be positioned around the structural element (402) at a first position along the axis with a radial spacing of 180° and a second set of two spacers (454) may be positioned around the structural element (402) at a second position along the axis with a radial spacing of 180°, such that the relative orientations of the first and second sets of spacers (454) are offset by 90°.

In another embodiment, the system for reinforcing a structural element (402) may additionally include an end cap (456) such as a bottom seal (470) to allow the chamber (406) to be filled with core filler material (426) without the core filler material (426) escaping through the bottom of the sleeve structure (410). As a non-limiting example, the bottom seal (470) may comprise a flexible elastic flange which is configured to slide along the structural element (402) as the sleeve structure (410) is lowered while maintaining a water-tight seal. The bottom seal (470) may include a slit so that it may be fit around the structural element (402) and then fastened at the slit, for example in cases where a torus-shaped material could not be fit around the structural element (402) due to some manner of cap at the top of the structural element (402). The bottom seal (470) may be attached to the sleeve structure (410) via a bottom seal fastener (472) such as a tight strap. In other embodiments, the sleeve structure may extend to the bottom of the structural element (402) and seal against a floor surface so as to prevent the core filler material (426) from escaping through the bottom of the sleeve structure (410).

In some embodiments, the sleeve structure (410) may additionally comprise a second segmented layer (414), comprising a plurality of stacked segments (416) which each surround the first segmented layer (412) and a plurality of horizontal seams (418) between the segments (416), the segments (416) disposed along the axis (404), wherein each segment (416) comprises two or more reinforcing shells (420) and two or more vertical seams (424) between the reinforcing shells (420). In some additional embodiments, the segments (416) of the second segmented layer (414) may have a diameter (417) that is larger than a diameter (417) of the segments (416) of the first segmented layer (412).

In some embodiments, the present invention features a sleeve structure (410) for reinforcement of a structural element (402). As a non-limiting example, the sleeve structure (410) may comprise: a plurality of reinforcing shells (420) configured to form a sleeve structure (410) around a length (405) of the structural element (402) such that there is a chamber (406) between the structural element (402) and the sleeve structure (410). In some embodiments, the sleeve structure (410) may comprise: a first segmented layer (412), comprising a plurality of stacked segments (416) and a plurality of horizontal seams (418) between the segments (416), the segments (416) disposed along an axis (404), wherein each segment (416) comprises two or more reinforcing shells (420) and two or more vertical seams (424) between the reinforcing shells (420); and a second segmented layer (414), comprising a plurality of stacked segments (416) which each surround the first segmented layer (412) and a plurality of horizontal seams (418) between the segments (416), the segments (416) disposed along the axis (404), wherein each segment (416) comprises two or more reinforcing shells (420) and two or more vertical seams (424) between the reinforcing shells (420).

In another embodiment, the present invention may provide a method of reinforcing a structural element. For example, the present invention may provide a method of reinforcing a structural element using any of the structures described herein. The methods and elements disclosed herein can be utilized to form new structures, retrofit existing structures, and/or repair or rehabilitate damaged structures (e.g. such as due to corrosion, deterioration, excessive loading, etc.). The structure may be a building, a bridge, a foundation, or the like. The structural element may be any component of the structure. Examples of structural elements include rods, beams, poles, columns, pipes, struts, studs, piles, tubes, bollards, and the like. The structural element may be of any suitable size or proportion, and may have any cross-sectional shape (e.g. circular, elongate, or square cross-section) or configuration (e.g. a flange) and can be designed for any purpose. In addition, the structural element can be constructed of any suitable material, such as concrete, metal, wood, plastic, masonry, stone, and combinations thereof.

The structural element may be present in a variety of locations, such as on, in, or partially in the ground, under or partially under water, and combinations thereof. In certain embodiments, the structural element is at least partially submerged in water (i.e., underwater). In various embodiments, the structural element is at least partially underground. In specific embodiments, the structural element is both at least partially submerged in water and at least partially underground. The term "partially", as used in this context, is used herein to refer to at least a portion of the structural element being underground and/or underwater.

The structural element comprises and extends between at least a first end and a second end, which are separated by a distance along an axis A. The distance between the first and second ends can be any distance, such as a distance of from 0.5 to 100,000 feet (where 1 foot is 0.3048 meters). Typically, the distance between the first and second ends is a distance of from 1 to 200, alternatively from 5 to 150, alternatively from 10 to 100 feet. The structural element may have other portions extending from the axis A. For example, in some embodiments the structural element may be bifurcated.

The structural element also presents an external surface having a perimeter extending for a distance around a plane lying perpendicular to the axis A (i.e., a cross section). The external surface presents a shape of the structural element. The shape of the structural element may be any shape, such as cubic, cylindrical, pyramidal, conical, prismatic, trapezoidal, and the like, and combinations thereof. The external surface may also be of any contour, such as smooth or rough, flat or textured, and the like, or combinations thereof. Moreover, any portion of the external surface may be the same as or different from any other portion of the external surface. In some embodiments, the external surface is substantially flat (or smooth). In certain embodiments, the external surface is textured (or rough). In specific embodiments, the external surface is ribbed and/or includes reinforcing structures. In specific embodiments, the shape of the structural element is a cylinder, such that the perimeter of the external surface of the structural element may be further defined as a circumference.

The structural element further includes an outer radius extending radially from the axis A to the external surface. The outer radius can be any distance, such as a distance of from 1/12 to 100 feet, although distances outside of this range are also contemplated for the outer radius. Typically, the outer radius will be a distance of from 1/6 to 75, alternatively from 1/5 to 50, alternatively from 1/4 to 25, alternatively from 1/3 to 10 feet. In some embodiments, the structural element is a concentric cylinder that includes the outer radius and further includes an inner radius that extends from the axis A for distance less than the outer radius. It is to be appreciated that the structural element may comprise multiple radii, each independently of the same or different distance, depending on the shape of the structural element.

The method can be used to reinforce any portion of the structural element or the entire structural element. In some embodiments, the method is used to reinforce only a portion of the structural element. In certain embodiments, the method is used to reinforce the entire structural element.

The method may utilize rigid, semi-rigid, or flexible fiber-reinforced shells. Typically, the method comprises a number of pairs of rigid, semi-rigid, or flexible fiber-reinforced shells, such as 1, 2, 3, 4, 5, 6, 7, 8, 9, 10, 11, 12, 13, 14, 15, 16, 17, 18, 19, or 20 (or more) pairs of rigid, semi-rigid, or flexible fiber-reinforced shells. Each pair of rigid, semi-rigid, or flexible fiber-reinforced shells comprises two rigid, semi-rigid, or flexible fiber-reinforced shells. For example, the method comprises at least a first pair of rigid, semi-rigid, or flexible fiber-reinforced shells comprising both a first rigid, semi-rigid, or flexible fiber-reinforced shell and a second rigid, semi-rigid, or flexible fiber-reinforced shell. In some embodiments, the method further comprises a second pair of rigid, semi-rigid, or flexible fiber-reinforced shells comprising a third rigid, semi-rigid, or flexible fiber-reinforced shell and a fourth rigid, semi-rigid, or flexible fiber-reinforced shell. In certain embodiments, the method further comprises additional pairs of rigid, semi-rigid, or flexible fiber-reinforced shells.

It is to be appreciated that each rigid, semi-rigid, or flexible fiber-reinforced shell is independently selected and any one of the rigid, semi-rigid, or flexible fiber-reinforced shells may be partially the same, substantially the same, or the same as any other of the rigid, semi-rigid, or flexible fiber-reinforced shells. The term "same" is to be understood to refer to one rigid, semi-rigid, or flexible fiber-reinforced shell having at least one common property, dimension, shape, composition, or the like, to another rigid, semi-rigid, or flexible fiber-reinforced shell. Accordingly, it is also to be understood that, absent description to the contrary, reference to any one or more particular rigid, semi-rigid, or flexible fiber-reinforced shell, in either a singular or a plural form, may be descriptive of one or more of the rigid, semi-rigid, or flexible fiber-reinforced shells generally, within a pair of rigid, semi-rigid, or flexible fiber-reinforced shells, within different pairs of rigid, semi-rigid, or flexible fiber-reinforced shells, and the like. Typically, depending on a configuration and shape of the structural element, both rigid, semi-rigid, or flexible fiber-reinforced shells of a pair of rigid, semi-rigid, or flexible fiber-reinforced shells are complementary in shape and dimension. For example, in some embodiments the first and second rigid, semi-rigid, or flexible fiber-reinforced shells of the first pair of rigid, semi-rigid, or flexible fiber-reinforced shells are substantially the same. Likewise, in some embodiments, the third and fourth rigid, semi-rigid, or flexible fiber-reinforced shells of the second pair of rigid, semi-rigid, or flexible fiber-reinforced shells are substantially the same. However, it is to be appreciated that the method may also utilize at least one pair of rigid, semi-rigid, or flexible fiber-reinforced shells comprising two rigid, semi-rigid, or flexible fiber-reinforced shells that are not complementary to one another.

Accordingly, any one of the rigid, semi-rigid, or flexible fiber-reinforced shells need not be substantially the same as any other of the rigid, semi-rigid, or flexible fiber-reinforced shells.

In general, each rigid, semi-rigid, or flexible fiber-reinforced shell comprises a first end and a second end, and a height extending for a distance between the first and second ends. In certain embodiments, the height of the rigid, semi-rigid, or flexible fiber-reinforced shells extends between the first and second ends for a distance along an axis A. However, it is to be appreciated that each rigid, semi-rigid, or flexible fiber-reinforced shell need not be linear. Rather, in some embodiments the rigid, semi-rigid, or flexible fiber-reinforced shells are curved, arcuate, bent, or combinations thereof. The height of each rigid, semi-rigid, or flexible fiber-reinforced shell can be any distance, such as a distance of from 1/12 to 1,000 feet. Typically, the height of each rigid, semi-rigid, or flexible fiber-reinforced shell is a distance of from 1/6 to 900, alternatively from 1/5 to 800, alternatively from 1/4 to 700, alternatively from 1/3 to 600, alternatively from 1/2 to 500, alternatively from 2/3 to 400, alternatively from 3/4 to 300, alternatively from 5/6 to 200, alternatively from 1 to 100, feet. Each rigid, semi-rigid, or flexible fiber-reinforced shell also includes at least a first edge and a second edge, with each of the first and second edges extending for a distance along at least a portion of the height of the rigid, semi-rigid, or flexible fiber-reinforced shell. The portion of the height may be any distance, such as a distance up to and including the entire distance of the height. In certain embodiments, the portion of the height is the entire distance of the height of the rigid, semi-rigid, or flexible fiber-reinforced shell, or a distance greater than the height of the rigid, semi-rigid, or flexible fiber-reinforced shell (i.e., when the first and/or second edge is not parallel to the height of the rigid, semi-rigid, or flexible fiber-reinforced shell). Each rigid, semi-rigid, or flexible fiber-reinforced shell also has a width extending for a distance between the first and second edges. The width of the rigid, semi-rigid, or flexible fiber-reinforced shell is typically perpendicular, or substantially perpendicular, to the height of the rigid, semi-rigid, or flexible fiber-reinforced shell. Likewise, the height of the rigid, semi-rigid, or flexible fiber-reinforced shell is typically parallel, or substantially parallel, to the first and second edges. However, in certain embodiments, the height is not parallel, or substantially parallel, to the first edge and/or second edge. Likewise, in these or other embodiments, the width of the rigid, semi-rigid, or flexible fiber-reinforced shell is not perpendicular, or substantially perpendicular, to the height of the rigid, semi-rigid, or flexible fiber-reinforced shell. The width of each rigid, semi-rigid, or flexible fiber-reinforced shell can be any distance, such as a distance of from 1/12 to 1,000 feet. Typically, the width of each rigid, semi-rigid, or flexible fiber-reinforced shell is a distance of from 1/6 to 900, alternatively from 1/5 to 800, alternatively from 1/4 to 700, alternatively from 1/3 to 600, alternatively from 1/2 to 500, alternatively from 2/3 to 400, alternatively from 3/4 to 300, alternatively from 5/6 to 200, alternatively from 1 to 100, feet.

Each rigid, semi-rigid, or flexible fiber-reinforced shell also presents at least an interior surface and an exterior surface. The interior and exterior surfaces of the rigid, semi-rigid, or flexible fiber-reinforced shell may be, independently, of any shape, texture, and/or contour, such as smooth or rough, flat or textured, and the like, or combinations thereof. Accordingly, it is to be appreciated that the interior and exterior surfaces of any one shell may be the same or different. As such, in some embodiments, the interior and exterior surfaces of any one shell are complementary. Additionally, the interior and/or exterior surface of any one of the rigid, semi-rigid, or flexible fiber-reinforced shells may be the same as or different from the interior and/or exterior surface of any other of the rigid, semi-rigid, or flexible fiber-reinforced shells. In some embodiments, the interior and/or exterior surface of the rigid, semi-rigid, or flexible fiber-reinforced shell is substantially flat. In certain embodiments, the interior and/or exterior surface of the rigid, semi-rigid, or flexible fiber-reinforced shell is textured. In specific embodiments, the interior and/or exterior surface of the rigid, semi-rigid, or flexible fiber-reinforced shell is ribbed and/or includes reinforcing structures.

In some embodiments, and as described in further detail below, the width of each rigid, semi-rigid, or flexible fiber-reinforced shell is independently a distance less than the distance of the perimeter of structural element, such as a distance of from 25 to 75, alternatively from 30 to 70, alternatively from 40 to 60, alternatively from 45 to 65, % of the perimeter of the structural element. In specific embodiments, the width of each of the first and second rigid, semi-rigid, or flexible fiber-reinforced shells is a distance of from 50 to 60% of the distance of the perimeter of the structural element. Additionally, the sum of the widths of the first and second rigid, semi-rigid, or flexible fiber-reinforced shells is a distance greater than the distance of the perimeter of the structural element. Furthermore, in some embodiments, the sum of the widths of the third and fourth rigid, semi-rigid, or flexible fiber-reinforced shells is a distance greater than the sum of the widths of the first and second rigid, semi-rigid, or flexible fiber-reinforced shells.

Each rigid, semi-rigid, or flexible fiber-reinforced shell may comprise a resin and a fiber. The resin may be any resin known in the art. Typically, thermosetting and/or thermoplastic resins are utilized due to the effectiveness of molding such resins through processes such as press molding, filament winding, or injection molding, and due to the good impact strength of molded products made therefrom. Accordingly, in some embodiments, the resin is a thermosetting and/or a thermoplastic resin. In these or other embodiments, elastomer or rubber can be added to or compounded with the thermosetting and/or thermoplastic resin to improve certain properties such as impact strength.

General examples of suitable thermosetting and/or thermoplastic resins typically include epoxy resins, polyester resins, phenolic resins (e.g. resol type), urea resins (e.g. melamine type), polyimide resins, and the like, as well as copolymers, modifications, and combinations thereof. Some specific examples of suitable thermosetting and/or thermoplastic resins include polyamides; polyesters such as polyethylene terephthalates, polybutylene terephthalates, polytrimethylene terephthalates, polyethylene naphthalates, liquid crystalline polyesters, and the like; polyolefins such as polyethylenes, polypropylenes, polybutylenes, and the like; styrenic resins; polyoxymethylenes; polycarbonates; polymethylenemethacrylates; polyvinyl chlorides; polyphenylene sulfides; polyphenylene ethers; polyimides; polyamideimides; polyetherimides; polysulfones; polyethersulfones; polyketones; polyetherketones; polyetheretherketones; polyetherketoneketones; polyarylates; polyethernitriles; phenolic resins; phenoxy resins; fluorinated resins, such as polytetrafluoroethylenes; thermoplastic elastomers, such as polystyrene types, polyolefin types, polyurethane types, polyester types, polyamide types, polybutadiene types, polyisoprene types, fluoro types, and the like; and copolymers, modifications, and combinations thereof.

In some embodiments the thermosetting and/or thermoplastic resin comprises, alternatively is, an epoxy resin. The term "epoxy" represents a compound comprising a cross-linked reaction product of a typically polymeric compound having one or more epoxide groups (i.e., an epoxide) and a curing agent. Thus, suitable epoxy resins include those formed by reacting an epoxide with a curing agent. The term "epoxy" is conventionally used to refer to an uncured resin that contains epoxide groups. With such usage, once cured, the epoxy resin is no longer an epoxy, or no longer includes epoxide groups, but for any unreacted or residual epoxide groups or reactive sites, which may remain after curing, as understood in the art. However, unless description to the contrary is provided, reference to epoxy herein in the context of an epoxy resin shall be understood to refer to a cured epoxy resin. The term "cured epoxy" shall be understood to mean the reaction product of an epoxide as defined herein and a curing agent as defined herein.

It is to be understood that the terms "curing agent" and "cross-linking agent" can be used interchangeably. Curing agents suitable for use in forming suitable epoxy resins are typically difunctional molecules that are reactive with epoxide groups. The term "cured" refers to a composition that has undergone cross-linking at an amount of from about 50% to about 100% of available cure sites. Additionally, the term "uncured" refers to the composition when it has undergone little or no cross-linking. However, it is to be understood that some of the available cure sites in an uncured composition may be cross-linked. Likewise, some of the available cure sites in a cured composition may remain uncross-linked. Thus, the terms "cured" and "uncured" may be understood to be functional terms. Accordingly, an uncured composition is typically characterized by a solubility in organic solvents and an ability to undergo plastic flow. In contrast, a cured composition suitable for the practice of the present invention is typically characterized by an insolubility in organic solvents and an absence of plastic flow under ambient conditions.

Examples of suitable epoxides include aliphatic, aromatic, cyclic, acyclic, and polycyclic epoxides, and modifications and combinations thereof. The epoxide may be substituted or unsubstituted, and hydrophilic or hydrophobic. Typically, the epoxide has an epoxy value (equiv./kg) of about 2 or greater, such as from 2 to 10, alternatively from 2 to 9, alternatively from 2 to 8, alternatively from 2 to 7, alternatively from 2.5 to 6.5.

Specific examples of suitable epoxides include glycidyl ethers of biphenol A and bisphenol F, epoxy novolacs (such as epoxidized phenol formaldehydes), naphthalene epoxies, trigylcidyl adducts of aminophenols, tetraglycidyl amines of methylenedianilines, triglycidyl isocyanurates, hexahydro-o-phthalic acid-bis-glycidyl esters, hexahydro-m-phthalic acid-bis-glycidyl esters, hexahydro-p-phthalicacid-bis-glycidyl esters, and modifications and/or combinations thereof.

Examples of suitable curing agents include phenols, such as biphenol, bisphenol A, bisphenol F, tetrabromobisphenol A, dihydroxydiphenyl sulfone, phenolic oligomers obtained by the reaction of above mentioned phenols with formaldehyde, and combinations thereof. Additional examples of suitable curing agents include anhydride curing agents such as nadic methyl anhydride, methyl tetrahydrophthalic anhydride, and aromatic anhydrides such pyromellitic dianhydride, biphenyltetracarboxylic acid dianhydride, benzophenonetetracarboxylic acid dianhydride, oxydiphthalic acid dianhydride, 4,4'-(hexafluoroisopropylidene) diphthalic acid dianhydride, naphthalene tetracarboxylic acid dianhydrides, thiophene tetracarboxylic acid dianhydrides, 3,4,9,10-perylenetetracarboxylic acid dianhydrides, pyrazine tetracarboxylic acid dianhydrides, 3,4,7,8-anthraquinone tetracarboxylic acid dianhydrides, oligomers or polymers obtained by the copolymerization of maleic anhydride with ethylene, isobutylene, vinyl methyl ether, and styrene, and combinations thereof. Further examples of suitable curing agents include maleic anhydride-grafted polybutadiene.

In some embodiments the thermosetting and/or thermoplastic resin comprises, alternatively is, a polyamide resin. Examples of suitable polyamides include polycaproamides (e.g. Nylon 6), polyhexamethyleneadipamides (e.g. Nylon 66), polytetramethyleneadipamides (e.g. Nylon 46), polyhexamethylenesebacamides (e.g. Nylon 610), polyhexamethylenedodecamides (e.g. Nylon 612), polyundecaneamides, polydodecaneamides, hexamethyleneadipamide/caproamide copolymers (e.g. Nylon 66/6), caproamide/hexamethyleneterephthalamide copolymers (e.g. Nylon 6/6T), hexamethyleneadipamide/hexamethyleneterephthalamide copolymers (e.g. Nylon 66/6T) hexamethyleneadipamide/hexamethyleneisophthalamide copolymers (e.g. Nylon 66/6I), hexamethyleneadipamide/hexamethyleneisophthalamide/caproamide copolymers (e.g. Nylon 66/6I/6), hexamethyleneadipamide/hexamethyleneterephthalamid/carpoamide copolymers (e.g. Nylon 66/6T/6), hexamethyleneterephthalamide/hexamethyleneisophthalamide copolymers (e.g. Nylon 6T/6I), hexamethyleneterephthalamide/dodecanamide copolymers (e.g. Nylon 6T/12), hexamethyleneadipamide/hexamethyleneterephthalamide/hexamethyleneisophthalamid e copolymers (e.g. Nylon 66/6T/6I), polyxylyleneadipamides, hexamethyleneterephthalamide/2-methyl-pentamethyleneterephthalamide copolymers, polymetaxylylenediamineadipamides (e.g. Nylon MXD6), polynonamethyleneterephthalamides (e.g. Nylon 9T), and combinations thereof.

In some embodiments the thermosetting and/or thermoplastic resin comprises, alternatively is, a phenol resin. Examples of suitable phenol resins include resins prepared by homopolymerzing or copolymerizing components containing at least a phenolic hydroxyl group. Specific examples of suitable phenol resins include phenolic resins such as phenolnovolaks, cresolnovolaks, octylphenols, phenylphenols, naphtholnovolaks, phenolaralkyls, naphtholaralkyls, phenolresols, and the like, as well as modified phenolic resins such as alkylbenzene modified (especially, xylene modified) phenolic resins, cashew modified phenolic resins, terpene modified phenolic resins, and the like. Further examples of suitable phenol resins include 2,2-bis(4-hydroxyphenyl)propane (generally referred to as bisphenol A), 2,2-bis(4-hydroxyphenyl)methane, 1,1-bis(4-hydroxyphenyl)ethane, 1,1-bis(4-hydroxyphenyl)cyclohexane, 2,2-bis(4-hydroxy-3,5-dimethylphenyl)propane, 2,2-bis(4-hydroxy-3,5-dibromophenyl)propane, 2,2-bis(hydroxy-3-methylphenyl)propane, bis(4-hydroxyphenyl)sulfide, bis(4-hydroxy-phenyl)sulfone, hydroquinone, resorcinol, 4,6-dimethyl-2,4,6-tri(4-hydroxyphenyl)heptene, 2,4,6-dimethyl-2,4,6-tri(4-hydroxyphenyl)heptane, 2,6-dimethyl-2,4,6-tri(4-hydroxyphenyl)heptene, 1,3,5-tri(4-hydroxyphneyl)benzene, 1,1,1-tri(4-hydroxyphenyl) ethane, 3,3-bis(4-hydroxyaryl)oxyindole, 5-chloro-3,3-bis(4-hydroxyaryl)oxyindole, 5,7-dichloro-3,3-bis(4-hydroxyaryl) oxyindole, 5-brome-3,3-bis(4-hydroxyaryl) oxyindole, and combinations thereof.

In some embodiments the thermosetting and/or thermoplastic resin comprises, alternatively is, a polyester resin. Examples of suitable polyester resins include polycondensation products of a dicarboxylic acid and a glycol, ring-opened polymers of a cyclic lactone, polycondensation products of a hydroxycarboxylic acid, and polycondensation products of a dibasic acid and a glycol. Specific examples of suitable polyester resins include polyethylene terephthalate resins, polypropylene terephthalate resins, polytrimethylene terephthalate resins, polybutylene terephthalate resins, polyethylene naphthalate resins, polybutylene naphthalate resins, polycyclohexanedimethylene terephthalate resins, polyethylene-1,2-bis(phenoxy) ethane-4,4'-dicarboxylate resins, polyethylene-1,2-bis(phenoxy)ethane-4,4'-dicarboxylate resins, as well as copolymer polyesters such as polyethylene isophthalate/terephthalate resins, polybutylene terephthalate/isophthalate resins, polybutylene terephthalate/decanedicarboxylate resins, and polycyclohexanedimethylene terephthalate/isophthalate resins, and combinations thereof.

The fiber comprises any fibrous material, such as carbon fiber, fiberglass, basalt fiber, natural fiber, metal fiber, polymer-based fibers such as aramid (e.g. Kevlar, Nomex, Technora), and combinations thereof. It is to be appreciated that the term "fiber" can denote a single fiber and/or a plurality of fibers. Herein, use of the term "fiber" denotes one or more individual fibers, which can be independently selected based on composition, size, length, and the like, or combinations thereof. For clarity and consistency, reference to "the fiber" is made herein, which is not intended to refer to just one fiber, but to any one fiber, which may be independently selected. The description below may relate to a single fiber, or all of the fibers, utilized.

In some embodiments, the fiber comprises more than one type of fibrous material. The fiber may be present in the rigid, semi-rigid, or flexible fiber-reinforced shells in the form of strings, wires, fabrics, tubes, particles, cables, strands, monofilaments, and combinations thereof. Additionally, the fiber may be woven or nonwoven. In some embodiments, the fiber is present in the rigid, semi-rigid, or flexible fiber-reinforced shells in the form of a filament product. Filament products include spun yarns (e.g. woven fabrics, knits, braids, etc.) webs (e.g. papers, mats, etc.), and chopped and milled fibers. In certain embodiments, the fiber is a staple product. Staple products include spun staple yarns, fabrics, knits, and braids of staple yarn, webs of staple including felts, mats, and papers, and chopped or milled staple fibers.

The fiber within each rigid, semi-rigid, or flexible fiber-reinforced shell may be randomly oriented or selectively oriented, such as aligned in one direction, oriented in cross directions, oriented in curved sections, and combinations thereof. The orientation of the fiber may be selected to provide various mechanical properties to the rigid, semi-rigid, or flexible fiber-reinforced shell such as tearing tendency, differential tensile strength along different directions, and the like.

In some embodiments, the fiber is arranged in the rigid, semi-rigid, or flexible fiber-reinforced shell in a direction running substantially parallel or parallel to the axis A, and the length of the fiber is substantially equal to the height of the rigid, semi-rigid, or flexible fiber-reinforced shell. When the fiber is curved, bent or twisted, the length of the fiber can be slightly longer than the height of the rigid, semi-rigid, or flexible fiber-reinforced shell. The phrase "substantially equal to" includes these cases. If almost equal shape of cross-section of the rigid, semi-rigid, or flexible fiber-reinforced shell is maintained in the axial direction, the length of the fiber may be generally regarded as substantially equal to the height of rigid, semi-rigid, or flexible fiber-reinforced shell. In certain embodiments, the fiber is arranged in the rigid, semi-rigid, or flexible fiber-reinforced shell in a direction running substantially perpendicular or perpendicular to the axis A, and the length of the fiber is substantially equal to the width of the rigid, semi-rigid, or flexible fiber-reinforced shell.

In some embodiments, the fiber is a carbon fiber. The carbon fiber may be or include graphene fibers, graphite fibers, and combinations thereof. The carbon fiber may be or include polyacrylonitrile (PAN)-type carbon fiber, pitch type carbon fiber, or combinations thereof. The carbon fiber may be in any form, such as single layer fibers, multilayer fibers, nanotubes, linked-particles, and combinations thereof. In these or other embodiments, the fiber further comprises an additional fibrous material, such as glass fiber, basalt fiber, natural fiber, metal fiber, polymer-based fiber such as aramid (e.g. Kevlar, Nomex, Technora), and the like, or combinations thereof.

In some embodiments, one or more of the rigid, semi-rigid, or flexible fiber-reinforced shells may further comprise additional components. Examples of additional components include: fillers, such as mica, talc, kaoline, sericite, bentonite, xonotlite, sepiolite, smectite, montmorillonite, wollastonite, silica, calcium carbonate, glass bead, glass flake, glass micro balloon, clay, molybdenum disulphide, titanium oxide, zinc oxide, antimony oxide, calcium polyphosphate, graphite, barium sulfate, magnesium sulfate, zinc borate, calcium borate, aluminum borate whisker, potassium titanate whisker, polymer, and the like; flame retardants and flame retardant aids; pigments; dyes; lubricants; releasing agents; compatibilizers; dispersants; crystallizing agents, such as mica, talc, kaoline, and the like; plasticizers, such as phosphate esters and the like; thermal stabilizers; antioxidants; anticoloring agents; UV absorbers; flowability modifiers; foaming agents; antimicrobial and/or antifouling agents; dust controlling agents; deodorants; sliding modifiers; antistatic agents, such as polyetheresteramide and the like; and combinations thereof. In certain embodiments, the rigid, semi-rigid, or flexible fiber-reinforced shells further comprise two or more additional components.

In some embodiments, the method further comprises forming the rigid, semi-rigid, or flexible fiber-reinforced shells. The rigid, semi-rigid, or flexible fiber-reinforced shells are typically formed by a molding process. Each rigid, semi-rigid, or flexible fiber-reinforced shell may be formed via independently selected techniques and/or methods. Accordingly, any one of the rigid, semi-rigid, or flexible fiber-reinforced shells may be formed by the same or different techniques and/or methods as any other of the rigid, semi-rigid, or flexible fiber-reinforced shells. Examples of suitable molding processes include: injection molding, such as injection compression molding, gas assisted injection molding, insert molding, and the like; blow molding; rotary molding; extrusion molding; press molding; transfer molding, such as resin transfer molding, resin injection molding, Seemann Composites Resin Infusion Molding Process, and the like; filament winding molding; autoclave molding; hand lay-up molding; and the like, and combinations thereof. In some embodiments, at least one of the rigid, semi-rigid, or flexible fiber-reinforced shells is formed via a single molding process, such as injection molding. In certain embodiments, at least one of the rigid, semi-rigid, or flexible fiber-reinforced shells is forming via more than one molding process, such as via a combination of extrusion and injection molding. In such certain embodiments, forming the rigid, semi-rigid, or flexible fiber-reinforced shells may be performed in a single mold or multiple molds. In various embodiments, forming the first and second rigid, semi-rigid, or flexible fiber-reinforced shells comprises extruding the first and second rigid, semi-rigid, or flexible fiber-reinforced shells.

It is to be appreciated that the techniques and methods described above may be used to form the rigid, semi-rigid, or flexible fiber-reinforced shells as a single layer or a composite comprising multiple layers. In some embodiments, at least one of the rigid, semi-rigid, or flexible fiber-reinforced shells is formed from a single shot/pour to give a single layer. In certain embodiments, at least one of the rigid, semi-rigid, or flexible fiber-reinforced shells is formed from multiple shots/pours to give multiple layers, e.g. a composite. In these or other embodiments, one or more of the multiple layers is a reinforcing layer comprising steel, plastic, wood, resin, plastic, and the like, or combinations thereof.

In specific embodiments, the rigid, semi-rigid, or flexible fiber-reinforced shells comprise carbon fiber-reinforced epoxy and are formed by extrusion molding.

As introduced above, the method includes (i) positioning the first rigid, semi-rigid, or flexible fiber-reinforced shell partially about a portion of the external surface presented by the structural element to leave an exposed portion of the structural element.

Positioning the first rigid, semi-rigid, or flexible fiber-reinforced shell partially about the portion of the external surface presented by the structural element comprises disposing at least a portion of the interior surface of the first rigid, semi-rigid, or flexible fiber-reinforced shell into close proximity with the portion of the external surface presented by the structural element. The term "close proximity" as used herein is to be understood to refer to a close distance, and to encompass situations including abutting, adjoining, touching, being spaced apart, being contiguous, being adjacent, and the like, and combinations thereof. The close distance may be any distance suitable for reinforcing the structural element with the method described herein, and may be selected on a basis of: the shape, size, location, and/or type of the structural element; the shape and/or size of one or more of the fiber-reinforced shells; adhering one of the rigid, semi-rigid, or flexible fiber-reinforced shells to another of the rigid, semi-rigid, or flexible fiber-reinforced shells and/or the structural element, as described in further detail below; or combinations thereof. In some embodiments, at least a portion of the interior surface of the first rigid, semi-rigid, or flexible fiber-reinforced shell is disposed about and contiguous to the external surface of the structural element. In certain embodiments, at least a portion of the interior surface of the first rigid, semi-rigid, or flexible fiber-reinforced shell is disposed about and spaced apart from the external surface of the structural element, e.g. to define a gap therebetween. In both such instances, the first rigid, semi-rigid, or flexible fiber-reinforced shell may be considered adjacent the structural element.

In some embodiments, the interior surface of the first rigid, semi-rigid, or flexible fiber-reinforced shell is shaped complementarily to at least a portion of the external surface presented by the structural element. By complementary shape, it is meant that the interior surface of the first rigid, semi-rigid, or flexible fiber-reinforced shell and the external surface of the structural element are similar in shape and dimension. In such some embodiments, positioning the first rigid, semi-rigid, or flexible fiber-reinforced shell partially about the portion of the external surface presented by the structural element typically comprises disposing the interior surface of the first rigid, semi-rigid, or flexible fiber-reinforced shell into close proximity with (i.e., adjacent to) the portion of external surface presented by the structural element that is complimentary to the interior surface of the first rigid, semi-rigid, or flexible fiber-reinforced shell.

The method also includes (ii) positioning the second rigid, semi-rigid, or flexible fiber-reinforced shell about the exposed portion of the structural element.

Positioning the second rigid, semi-rigid, or flexible fiber-reinforced shell about the exposed portion of the structural element comprises disposing at least a portion of the interior surface of the second rigid, semi-rigid, or flexible fiber-reinforced shell into close proximity with (i.e., adjacent to) the exposed portion of the external surface of the structural element. In some embodiments, the interior surface of the second rigid, semi-rigid, or flexible fiber-reinforced shell is shaped complementarily to at least a portion of the exposed portion of the external surface of the structural element. In such some embodiments, positioning the second rigid, semi-rigid, or flexible fiber-reinforced shell about the exposed portion of the structural element typically comprises disposing the interior surface of the second rigid, semi-rigid, or flexible fiber-reinforced shell into close proximity with the portion of the shape presented by the exposed portion of the external surface of the structural element that is complimentary to the interior surface of the first rigid, semi-rigid, or flexible fiber-reinforced shell. In some embodiments, at least a portion of the interior surface of the second rigid, semi-rigid, or flexible fiber-reinforced shell is disposed about and contiguous to the external surface of the structural element. In certain embodiments, at least a portion of the interior surface of the second rigid, semi-rigid, or flexible fiber-reinforced shell is disposed about and spaced from the external surface of the structural element, e.g. to define a gap therebetween.

Positioning the second rigid, semi-rigid, or flexible fiber-reinforced shell about the exposed portion of the structural element also comprises disposing the first edge of the second rigid, semi-rigid, or flexible fiber-reinforced shell adjacent to the first edge of the first rigid, semi-rigid, or flexible fiber-reinforced shell to give a first seam and disposing the second edge of the second rigid, semi-rigid, or flexible fiber-reinforced shell adjacent to the second edge of the first rigid, semi-rigid, or flexible fiber-reinforced shell to give a second seam, thereby enveloping at least a portion of the structural element. The first and/or second edges of the first and second rigid, semi-rigid, or flexible fiber-reinforced shells may be disposed contiguous to, overlapping with, or spaced apart from one another, or combinations thereof. In some embodiments, the first and/or second edges of the first and second rigid, semi-rigid, or flexible fiber-reinforced shells are disposed contiguous to one another. In certain embodiments, the first and/or second edges of the first and second rigid, semi-rigid, or flexible fiber-reinforced shells are disposed adjacent to, but not touching, one another. In specific embodiments, the first and/or second and/or second edges of the first and second rigid, semi-rigid, or flexible fiber-reinforced shells are disposed overlapping one another.

It is to be appreciated that the widths of the first and second rigid, semi-rigid, or flexible fiber-reinforced shells determine the orientation of the first and second seams, with respect to one another, about the axis A. For example, where the widths of the first and second rigid, semi-rigid, or flexible fiber-reinforced shells are substantially equal, the first and second seams are substantially opposite one another about the axis A. Typically, the first and second seams are arranged about the axis A in an orientation of from 170 to 190, alternatively from 175 to 185, alternatively of 180, degrees with respect to one another. This orientation of the seams, relative to each other, may depend on the number of layers of shells.

The method further includes (iii) adhering the first and second rigid, semi-rigid, or flexible fiber-reinforced shells to the structural element.

Adhering the first and second rigid, semi-rigid, or flexible fiber-reinforced shells to the structural element typically comprises applying a first adhesive between the interior surfaces of the first and second rigid, semi-rigid, or flexible fiber-reinforced shells and the external surface presented by the structural element. The first adhesive can be applied by any means, such as via brushing, rolling, spraying, pumping, and the like. The first adhesive can be applied manually or by an automated process. In certain embodiments, the first adhesive is applied between the interior surfaces of the first and second rigid, semi-rigid, or flexible fiber-reinforced shells and the external surface presented by the structural element by pumping or spraying, such as via an applicator or spray gun. If the first and second rigid, semi-rigid, or flexible fiber-reinforced shells are positioned such that there is a gap between the first and second rigid, semi-rigid, or flexible fiber-reinforced shells and the exterior structural element, the first adhesive can be disposed in the gap by any such techniques. It is also to be appreciated that the first adhesive may be applied to the interior surfaces of the first and second rigid, semi-rigid, or flexible fiber-reinforced shells and the external surface of the structural element at any time, and in any order. For example, in some embodiments, the first adhesive may be applied to the interior surfaces of the first and second rigid, semi-rigid, or flexible fiber-reinforced shells prior to such shells being positioned about the structural element. In these or other embodiments, the first adhesive may be applied to the interior surfaces of the first and second rigid, semi-rigid, or flexible fiber-reinforced shells subsequent to such shells being positioned about the structural element. In some embodiments, the first adhesive may be applied to the external surface of the structural element prior to the first and second rigid, semi-rigid, or flexible fiber-reinforced shells such shells being positioned about the structural element.

The first adhesive can be any adhesive suitable for bonding the first and second rigid, semi-rigid, or flexible fiber-reinforced shells to the structural element, such as a cement, glue, resin, and the like. Further, the first adhesive can bond the first and second rigid, semi-rigid, or flexible fiber-reinforced shells to the structural element via chemical bonding, mechanical bonding, and combinations thereof. Typically, the first adhesive comprises a polymer, or a combination of components that are polymerized before, during, and/or after adhering the first and second rigid, semi-rigid, or flexible fiber-reinforced shells to the structural element. Accordingly, the first adhesive can be solvent based, such as a dispersion, emulsion, or solution.

Examples of suitable adhesives for use as the first adhesive include non-reactive adhesives, such as hot melt adhesives, drying adhesives, pressure-sensitive adhesives, contact adhesives, and the like, and reactive adhesives, such as single-component adhesives and multi-component adhesives. Specific examples of suitable adhesives include epoxies, polyurethanes, polyolefins, ethylene-vinyl acetates, polyamides, polyesters, styrene block copolymers, polycarbonates, fluoropolymers, silicone rubbers, and the like, and combinations thereof. Particular examples of suitable adhesives include adhesive carbon bond putties produced by Composite Construction LLC. In some embodiments, the first adhesive is a resin comprising an epoxy. In these or other embodiments, the first adhesive is a resin comprising an epoxy and an amine curing agent. In such embodiments, the first adhesive is typically applied as an uncured resin.

In certain embodiments, the method further comprises repeating (i)-(iii) described above, along the distance of the structural element between the first and second ends with additional rigid, semi-rigid, or flexible fiber-reinforced shells. In such certain embodiments, pairs of the additional rigid, semi-rigid, or flexible fiber-reinforced shells may be positioned along the distance of the structural element such that the first and/or second ends of one pair of the additional rigid, semi-rigid, or flexible fiber-reinforced shells is adjacent the first and/or second end of another pair of the additional rigid, semi-rigid, or flexible fiber-reinforced shells (e.g. in a stacked arrangement). Multiple different stacked arrangements may be utilized together.

In certain embodiments, the method additionally comprises (iv) positioning the third rigid, semi-rigid, or flexible fiber-reinforced shell about at least one of the first and second seams, to leave the other of the first and second seams as an exposed seam. In such certain embodiments, positioning the third rigid, semi-rigid, or flexible fiber-reinforced shell about at least one of the first and second seams comprises disposing at least a portion of the interior surface of the third rigid, semi-rigid, or flexible fiber-reinforced shell into close proximity with the first or second seam, a portion of the exterior surface of the first rigid, semi-rigid, or flexible fiber-reinforced shell, and a portion of the exterior surface of the second rigid, semi-rigid, or flexible fiber-reinforced shell. In some embodiments, the interior surface of the third rigid, semi-rigid, or flexible fiber-reinforced shell is shaped complementarily to the portion of the exterior surface of the first rigid, semi-rigid, or flexible fiber-reinforced shell and the portion of the exterior surface of the second rigid, semi-rigid, or flexible fiber-reinforced shell. In specific embodiments, the method comprises positioning the third rigid, semi-rigid, or flexible fiber-reinforced shell about the first seam. In other embodiments, the method comprises positioning the third rigid, semi-rigid, or flexible fiber-reinforced shell about the second seam. In some embodiments, at least a portion of the interior surface of the third rigid, semi-rigid, or flexible fiber-reinforced shell is disposed about and contiguous to the exterior surface of the first and second rigid, semi-rigid, or flexible fiber-reinforced shells. In certain embodiments, at least a portion of the interior surface of the third rigid, semi-rigid, or flexible fiber-reinforced shell is disposed about and spaced apart from the exterior surface of the first and second rigid, semi-rigid, or flexible fiber-reinforced shells.

In further embodiments, the method also comprises (v) positioning the fourth rigid, semi-rigid, or flexible fiber-reinforced shell about the exposed seam.

Positioning the fourth rigid, semi-rigid, or flexible fiber-reinforced shell about the exposed seam typically comprises disposing the first edge of the fourth rigid, semi-rigid, or flexible fiber-reinforced shell adjacent to the first edge of the third rigid, semi-rigid, or flexible fiber-reinforced shell to give a third seam and disposing the second edge of the fourth rigid, semi-rigid, or flexible fiber-reinforced shell adjacent to the second edge of the third rigid, semi-rigid, or flexible fiber-reinforced shell to give a fourth seam, thereby enveloping the first and second rigid, semi-rigid, or flexible fiber-reinforced shells with the third and fourth rigid, semi-rigid, or flexible fiber-reinforced shells. The first and/or second edges of the third and fourth rigid, semi-rigid, or flexible fiber-reinforced shells may be disposed contiguous to, overlapping with, or spaced apart from one another, or combinations thereof. In some embodiments, the first and/or second edges of the third and fourth rigid, semi-rigid, or flexible fiber-reinforced shells are disposed contiguous to one another. In other embodiments, the first and/or second edges of the third and fourth rigid, semi-rigid, or flexible fiber-reinforced shells are disposed adjacent to, but not touching, one another. In specific embodiments, the first and/or second edges of the first and second rigid, semi-rigid, or flexible fiber-reinforced shells are disposed overlapping one another.

In some embodiments, at least a portion of the interior surface of the fourth rigid, semi-rigid, or flexible fiber-reinforced shell is disposed about and contiguous to the exterior surface of the first and second rigid, semi-rigid, or flexible fiber-reinforced shells. In certain embodiments, at least a portion of the interior surface of the fourth rigid, semi-rigid, or flexible fiber-reinforced shell is disposed about and spaced apart from the exterior surface of the first and second rigid, semi-rigid, or flexible fiber-reinforced shells.

It is to be appreciated that the widths of the third and fourth rigid, semi-rigid, or flexible fiber-reinforced shells determine the orientation of the third and fourth seems, with respect to one another, about the axis A. For example, where the widths of the third and fourth rigid, semi-rigid, or flexible fiber-reinforced shells are substantially equal, the third and fourth seams are substantially opposite one another about the axis A. Typically, the third and fourth seams are arranged about the axis A in an orientation of from 170 to 190, alternatively from 175 to 185, alternatively of 180, degrees with respect to one another. This orientation of the seams, relative to each other, may depend on the number of layers of shells.

The third and fourth seams may be offset relative to the first and second seams about the axis A. In particular embodiments, the third and fourth seams are offset about 90 degrees, relative to the first and second seams, about the axis A, such that each of the first, second, third, and fourth seams is spaced about 90 degrees from one another about the axis A. In such embodiments, the term "about 90 degrees" is used to refer to an offset from one another about the axis A of from 80 to 110, alternatively from 85 to 95, alternatively of 90, degrees.

It is to be appreciated that the third and fourth rigid, semi-rigid, or flexible fiber-reinforced shells may be the same as or different from the first and second rigid, semi-rigid, or flexible fiber-reinforced shells. In some embodiments, the third and fourth rigid, semi-rigid, or flexible fiber-reinforced shells are the same as the first and second rigid, semi-rigid, or flexible fiber-reinforced shells but with a larger perimeter.

In further embodiments, the method also comprises (vi) adhering the third and fourth rigid, semi-rigid, or flexible fiber-reinforced shells about the first and second rigid, semi-rigid, or flexible fiber-reinforced shells.

Adhering the third and fourth rigid, semi-rigid, or flexible fiber-reinforced shells about the first and second rigid, semi-rigid, or flexible fiber-reinforced shells typically comprises applying a second adhesive between the interior surfaces of the third and fourth rigid, semi-rigid, or flexible fiber-reinforced shells and the exterior surfaces of the first and second rigid, semi-rigid, or flexible fiber-reinforced shells. The second adhesive can be applied by any means, such as via brushing, rolling, spraying, pumping, and the like. The second adhesive can be applied manually or by an automated process. In certain embodiments, the second adhesive is applied between the interior surfaces of the third and fourth rigid, semi-rigid, or flexible fiber-reinforced shells and the exterior surface of the first and second rigid, semi-rigid, or flexible fiber-reinforced shells by pumping or spraying, such as via an applicator or spray gun. It is also to be appreciated that the second adhesive may be applied to the interior surfaces of the third and fourth rigid, semi-rigid, or flexible fiber-reinforced shells and the exterior surface of the first and second rigid, semi-rigid, or flexible fiber-reinforced shells at any time, and in any order. For example, in some embodiments, the second adhesive may be applied to the interior surfaces of the third and fourth rigid, semi-rigid, or flexible fiber-reinforced shells prior to such shells being positioned about the first and second rigid, semi-rigid, or flexible fiber-reinforced shells. In these or other embodiments, the second adhesive may be applied to the interior surfaces of the third and fourth rigid, semi-rigid, or flexible fiber-reinforced shells subsequent to such shells being positioned about the first and second rigid, semi-rigid, or flexible fiber-reinforced shells. In some embodiments, the second adhesive may be applied to the exterior surface of the first and second rigid, semi-rigid, or flexible fiber-reinforced shells prior to the third and fourth rigid, semi-rigid, or flexible fiber-reinforced shells such shells being positioned about the first and second rigid, semi-rigid, or flexible fiber-reinforced shells.

The second adhesive can be any adhesive suitable for bonding the third and fourth rigid, semi-rigid, or flexible fiber-reinforced shells to the first and second rigid, semi-rigid, or flexible fiber-reinforced shells, such as a cement, glue, resin, and the like. Further, the second adhesive can bond the third and fourth rigid, semi-rigid, or flexible fiber-reinforced shells to the first and second rigid, semi-rigid, or flexible fiber-reinforced shells via chemical bonding, mechanical bonding, and combinations thereof. Typically, the second adhesive comprises a polymer, or a combination of components that are polymerized before, during, and/or after adhering the third and fourth rigid, semi-rigid, or flexible fiber-reinforced shells to the first and second rigid, semi-rigid, or flexible fiber-reinforced shells. Accordingly, the second adhesive can be solvent based, such as a dispersion, emulsion, or solution.

Examples of suitable adhesives for use as the second adhesive include non-reactive adhesives, such as hot melt adhesives, drying adhesives, pressure-sensitive adhesives, contact adhesives, and the like, and reactive adhesives, such as single-component adhesives and multi-component adhesives. Specific examples of suitable adhesives include epoxies, polyurethanes, polyolefins, ethylene-vinyl acetates, polyamides, polyesters, styrene block copolymers, polycarbonates, fluoropolymers, silicone rubbers, and the like, and combinations thereof. Particular examples of suitable adhesives for use as the second adhesive include adhesive carbon bond putties produced by Composite Construction LLC. In some embodiments, the second adhesive is a resin comprising an epoxy. In these or other embodiments, the second adhesive is a resin comprising an epoxy and an amine curing agent. In such embodiments, the second adhesive is typically applied as an uncured resin. It is to be appreciated that the second adhesive may be the same or different from the first adhesive. As such, in some embodiments, the first and second adhesives are the same. In other embodiments, the first and second adhesives are different.

In certain embodiments, the method further comprises repeating (iv) through (vi) described above, along the length of the structural element between the first and second ends with additional pairs of the rigid, semi-rigid, or flexible fiber-reinforced shells.

It is to be appreciated that (iv) through (vi) can be repeated using the additional pairs of the rigid, semi-rigid, or flexible fiber-reinforced shells. For example, the method may additionally comprise (vii) positioning a fifth rigid, semi-rigid, or flexible fiber-reinforced shell about one of the third and fourth seams, (vii) positioning a sixth rigid, semi-rigid, or flexible fiber-reinforced shell about the other of the third and fourth seams, and (ix) adhering the fifth and sixth rigid, semi-rigid, or flexible fiber-reinforced shells to the third and fourth rigid, semi-rigid, or flexible fiber-reinforced shells, using any of the methods and materials described above.

It is also to be appreciated that the method can be repeated to reinforce any or all portions of the structural element. For example, in some embodiments, the method is used to reinforce the entire distance between the first and second ends of the structural element. In other embodiments, the method is used to reinforce only a portion of the distance between the first and second ends of the structural element. Furthermore, the method can be used to reinforce any number of different portions of the structural element. Accordingly, the rigid, semi-rigid, or flexible fiber-reinforced shells may envelop the entire structural element, may envelop only a portion, or may envelop multiple portions of the structural element. In some embodiments, the rigid, semi-rigid, or flexible fiber-reinforced shells envelop the first and/or second end of the structural element such that the first or second ends of the rigid, semi-rigid, or flexible fiber-reinforced shells are conterminal with the first and/or second end of the structural element. In certain embodiments, the rigid, semi-rigid, or flexible fiber-reinforced shells envelop the first and/or second end of the structural element such that the first or second ends of the rigid, semi-rigid, or flexible fiber-reinforced shells extend for a distance past the first and/or second end of the structural element along the axis A.

It is further to be appreciated that the rigid, semi-rigid, or flexible fiber-reinforced shells may be disposed about the structural element in any configuration. For example, the first and second ends of both the first or second rigid, semi-rigid, or flexible fiber-reinforced shells of any one pair of rigid, semi-rigid, or flexible fiber-reinforced shells may be aligned or misaligned, such as in a conterminal configuration, staggered configuration, or combinations thereof. In some embodiments, the first and second ends of both the first and second rigid, semi-rigid, or flexible fiber-reinforced shells of any one pair rigid, semi-rigid, or flexible fiber-reinforced shells are aligned in a conterminal configuration. In specific embodiments, the first and second ends of both the first and second rigid, semi-rigid, or flexible fiber-reinforced shells of any one pair rigid, semi-rigid, or flexible fiber-reinforced shells are misaligned, such that the rigid, semi-rigid, or flexible fiber-reinforced shells are oriented about the structural element in a staggered configuration. In some embodiments, any of the first and/or second ends of any of the rigid, semi-rigid, or flexible fiber-reinforced shells may be conterminal or staggered with respect to any other of the first and/or second ends of any of the rigid, semi-rigid, or flexible fiber-reinforced shells.

With reference to the specific embodiment of the Figures, wherein like numerals generally indicate like parts throughout the several views, FIG. 1 shows a first pair of rigid, semi-rigid, or flexible fiber-reinforced shells that comprises a first rigid, semi-rigid, or flexible fiber-reinforced shell 12 and a second rigid, semi-rigid, or flexible fiber-reinforced shell 14, which are positioned to form a first seam 16 and a second seam 18. FIG. 1 also shows a second pair of rigid, semi-rigid, or flexible fiber-reinforced shells 20 disposed about the first pair of rigid, semi-rigid, or flexible fiber-reinforced shells 10. The second pair of rigid, semi-rigid, or flexible fiber-reinforced shells 20 comprises a third rigid, semi-rigid, or flexible fiber-reinforced shell 22 and a fourth rigid, semi-rigid, or flexible fiber-reinforced shell 24, which are positioned to form a third seam 26 and a fourth seam (not shown).

Figure 2:
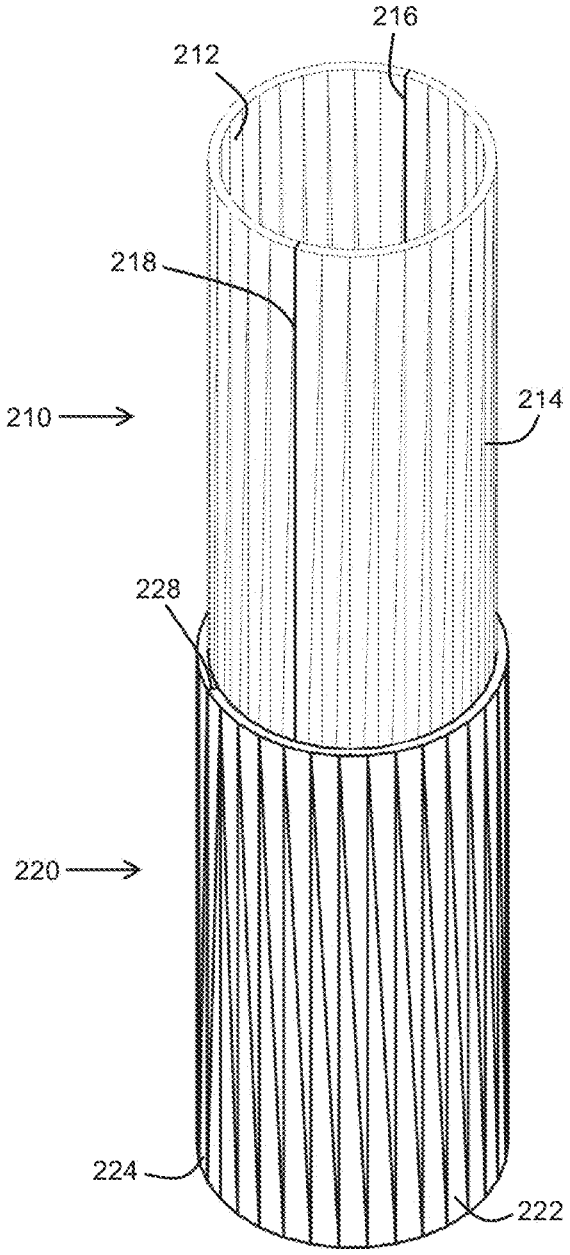
FIG. 2 shows a third pair of rigid, semi-rigid, or flexible fiber-reinforced shells and a fourth pair of rigid, semi-rigid, or flexible fiber-reinforced shells disposed about the third pair of rigid, semi-rigid, or flexible fiber-reinforced shells.

FIG. 2 shows a third pair of rigid, semi-rigid, or flexible fiber-reinforced shells 210 comprising a fifth rigid, semi-rigid, or flexible fiber-reinforced shell 212 and a sixth rigid, semi-rigid, or flexible fiber-reinforced shell 214, which are positioned to form a fifth seam 216 and a sixth seam 218. FIG. 2 also shows a fourth pair of rigid, semi-rigid, or flexible fiber-reinforced shells 220 disposed about the third pair of rigid, semi-rigid, or flexible fiber-reinforced shells. The fourth pair rigid, semi-rigid, or flexible fiber-reinforced shells 220 comprises a seventh rigid, semi-rigid, or flexible fiber-reinforced shell 222 and an eighth rigid, semi-rigid, or flexible fiber-reinforced shell 224, which are positioned to form a seventh seam (not shown) and a eighth seam 228.

Figure 3:
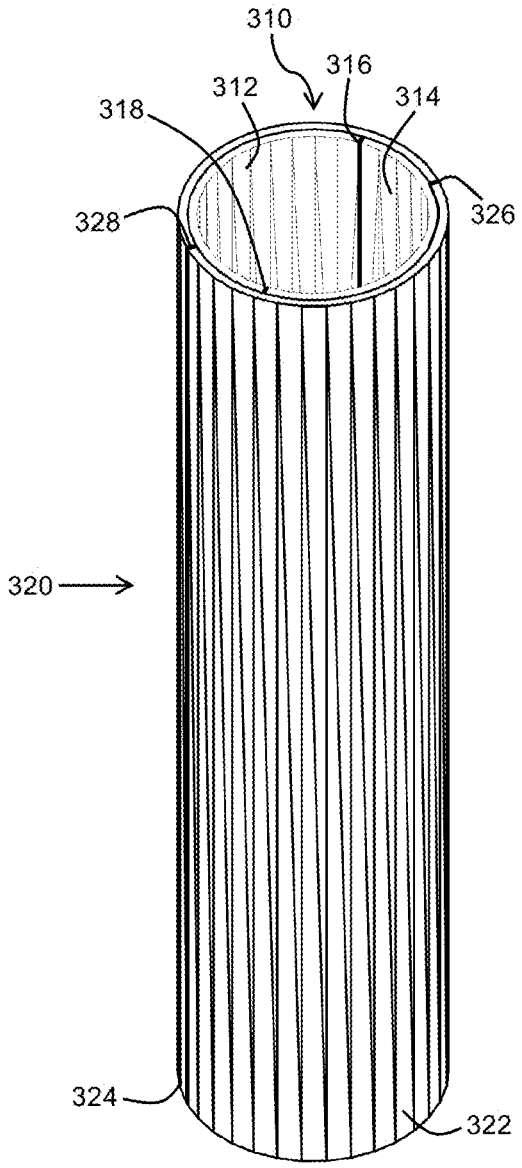
FIG. 3 shows a fifth pair of rigid, semi-rigid, or flexible fiber-reinforced shells and a sixth pair of rigid, semi-rigid, or flexible fiber-reinforced shells disposed about the fifth pair of rigid, semi-rigid, or flexible fiber-reinforced shells.

FIG. 3 shows a fifth pair of rigid, semi-rigid, or flexible fiber-reinforced shells 310 comprising a ninth rigid, semi-rigid, or flexible fiber-reinforced shell 312 and a tenth rigid, semi-rigid, or flexible fiber-reinforced shell 314, which are positioned to form a ninth seam 316 and a tenth seam 318. FIG. 3 also shows a sixth pair of rigid, semi-rigid, or flexible fiber-reinforced shells 320 disposed about the fifth pair of rigid, semi-rigid, or flexible fiber-reinforced shells 310. The sixth pair of rigid, semi-rigid, or flexible fiber-reinforced shells 320 comprises an eleventh rigid, semi-rigid, or flexible fiber-reinforced shell 322 and a twelfth rigid, semi-rigid, or flexible fiber-reinforced shell 324, which are positioned to form a eleventh seam 326 and a twelfth seam 328.

Figure 4:
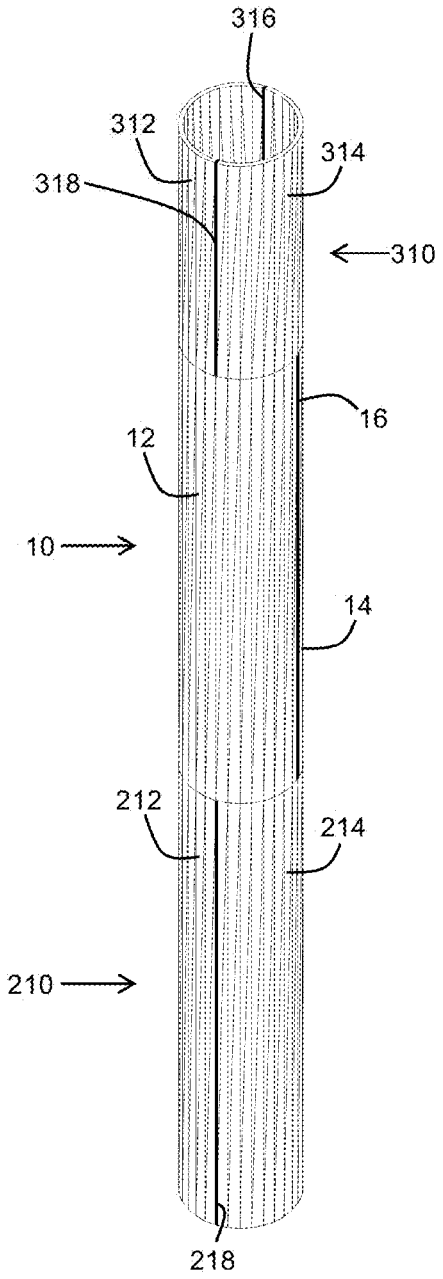
FIG. 4 shows the first, third, and fifth pairs of rigid, semi-rigid, or flexible fiber-reinforced shells positioned in a stacked arrangement.

FIG. 4 shows the first, third, and fifth pairs of rigid, semi-rigid, or flexible fiber-reinforced shells (10, 210, and 310, respectively) positioned in a stacked arrangement.

Figure 5:
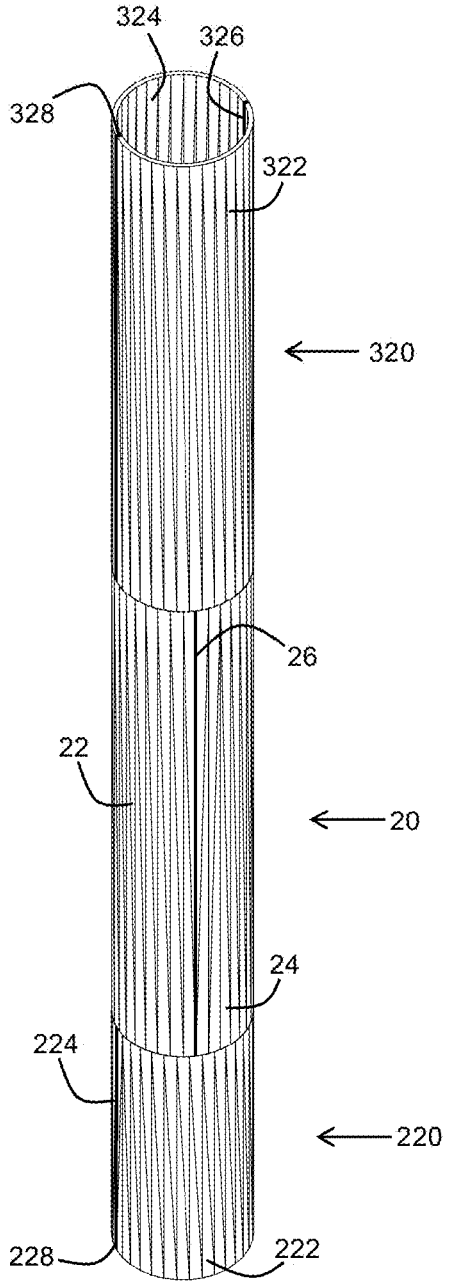
FIG. 5 shows the second, fourth, and sixth pairs of rigid, semi-rigid, or flexible fiber-reinforced shells positioned in a stacked arrangement.

FIG. 5 shows the second, fourth, and sixth pairs of rigid, semi-rigid, or flexible fiber-reinforced shells (20, 220, and 320, respectively) positioned in a stacked arrangement.

Figure 6:
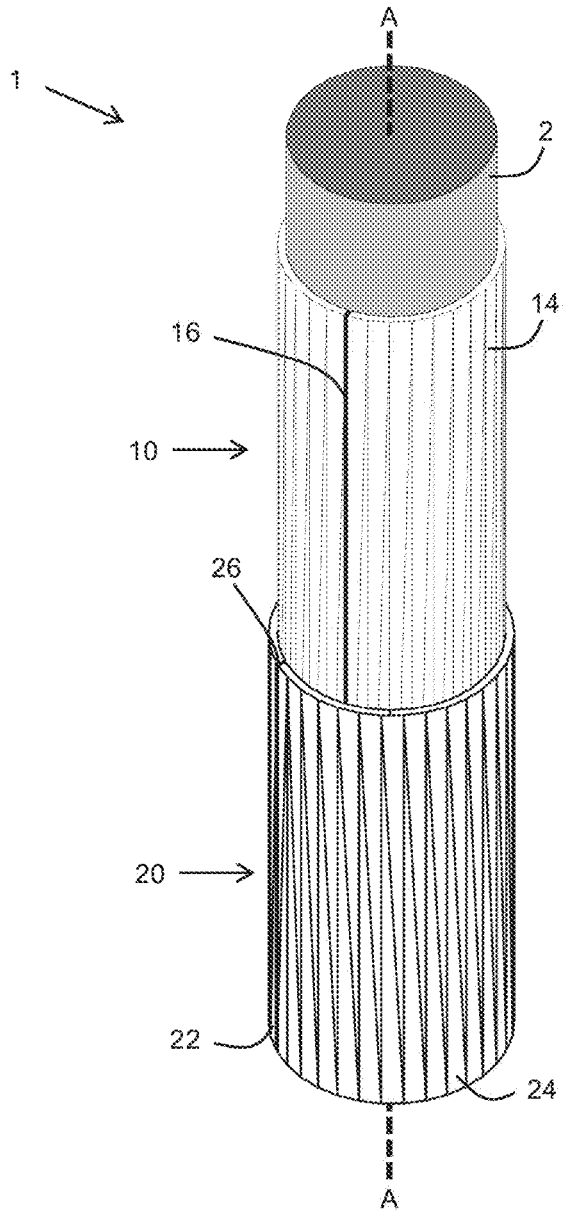
FIG. 6 shows a reinforced structural element formed in accordance with the method.
Figure 7:
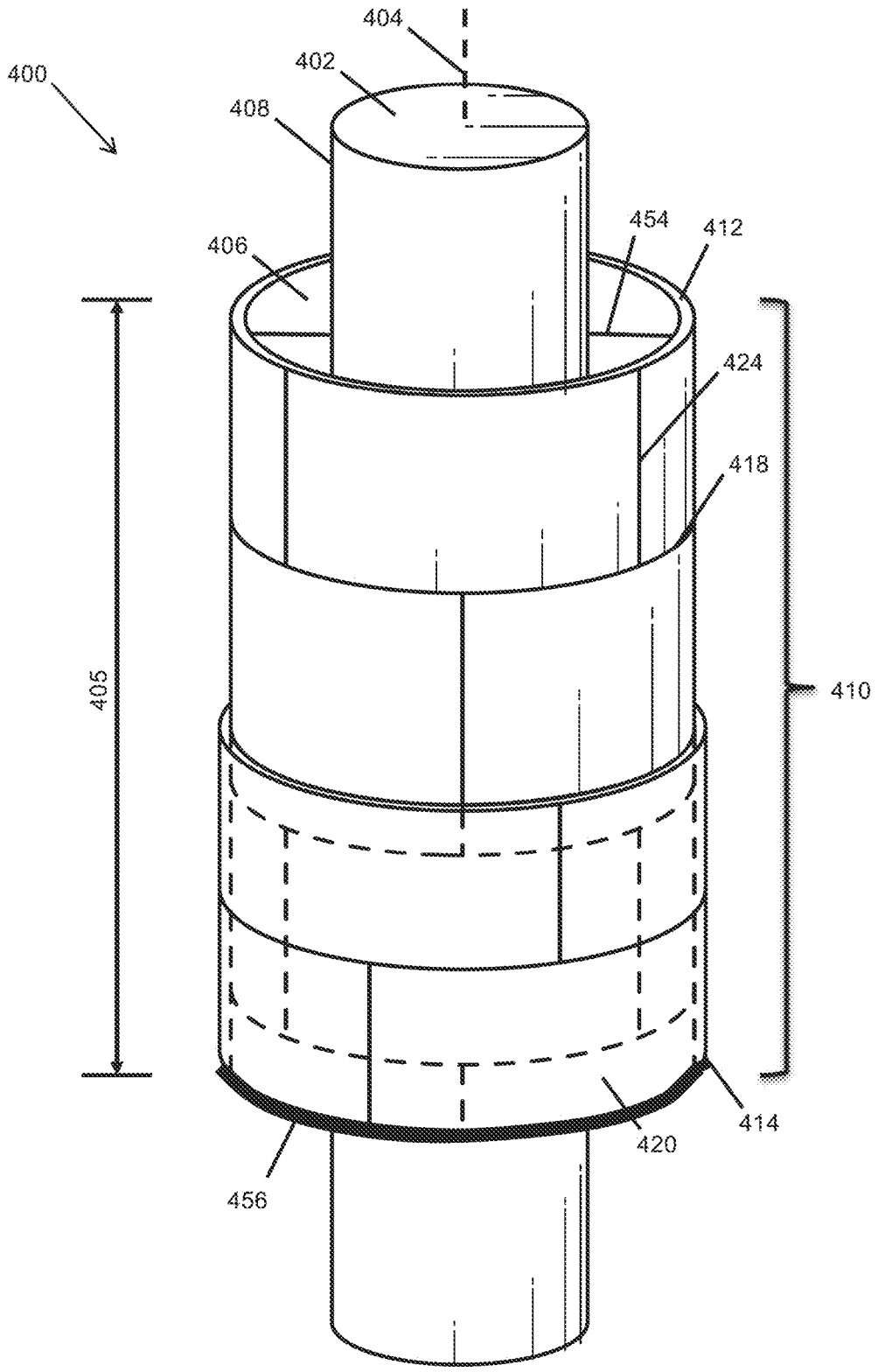
FIG. 7 shows a reinforced structural element of the present invention.
Figure 8A:
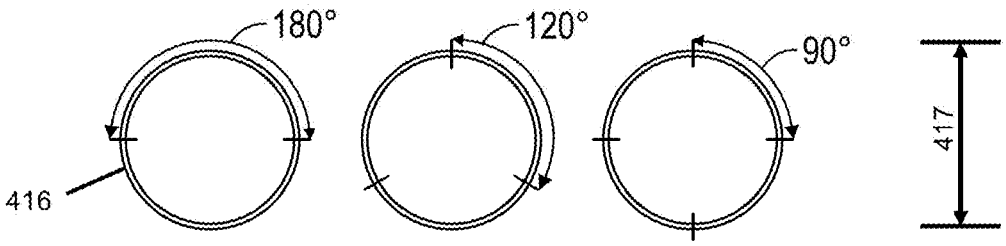
FIG. 8A shows segments of a segmented layer, made of reinforcing shells connected by vertical seams. The segment on the left has two reinforcing shells and two seams 180° apart. The segment in the center has three reinforcing shells and three seams 120° apart. The segment on the right has four reinforcing shells and four seams 90° apart.
Figure 8B:
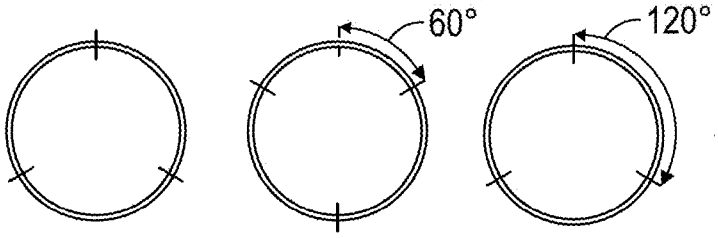
FIG. 8B shows an example staggering sequence for three consecutive segments of a segmented layer. The first segment, on the left, has an orientation such that a vertical seam is pointed towards the top of the page. The second segment in the center has been rotated clockwise 60°, or half the 120° between the vertical seams. The third segment, on the right, has been rotated an additional 60° clockwise for a total rotation from the original orientation of 120°. As such, the first and third segments have seams which are aligned, but each adjacent segment has vertical seams which are staggered relative to the other adjacent segment. This pattern repeats every third segment.
Figure 8C:
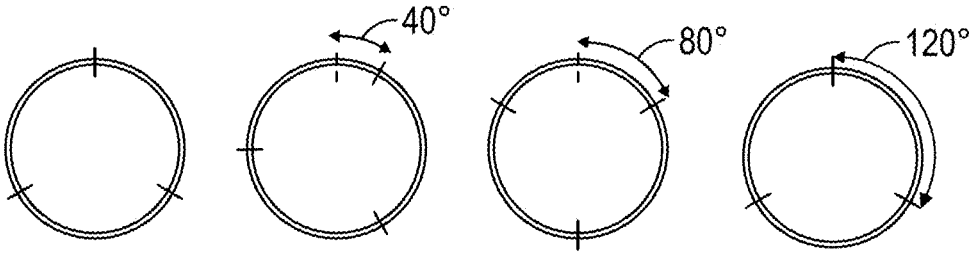
FIG. 8C shows an example staggering sequence for four consecutive segments of a segmented layer. The first segment, on the far left, has an orientation such that a vertical seam is pointed towards the top of the page. The second segment on the near left, has been rotated clockwise 40°, or a third of the 120° between the vertical seams. The third segment, on the near right, has been rotated an additional 40° clockwise for a total rotation from the original orientation of 80°. The fourth segment, on the far right, has been rotated an additional 40° clockwise for a total rotation from the original orientation of 120°. As such, the first and fourth segments have seams which are aligned, but each adjacent segment has vertical seams which are staggered relative to the other adjacent segment. This pattern repeats every fourth segment.
Figure 8D:
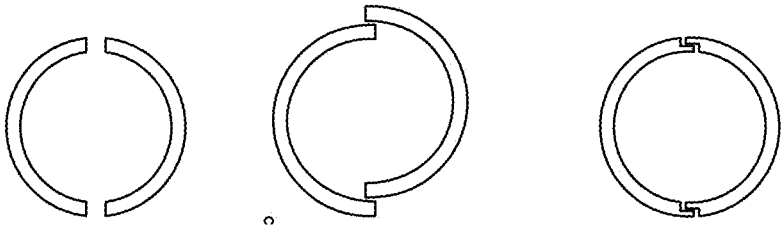
FIG. 8D shows three methods of joining reinforcing shells to form a segment. The segment on the left has butt joints. The segment in the center has full-thickness overlap joints. The segment on the right has half-thickness overlap joint.
Figure 8E:
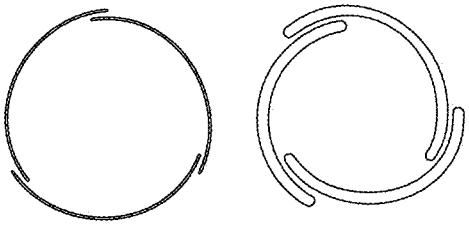
FIG. 8E shows that the thickness of the reinforcing shells may determine the amount of overlap required to form a strong bond. The segment on the left has thin reinforcing shells and a small overlap distance for each joint. The segment on the right has thicker reinforcing shells and a wider overlap distance for each joint.
Figure 9A:
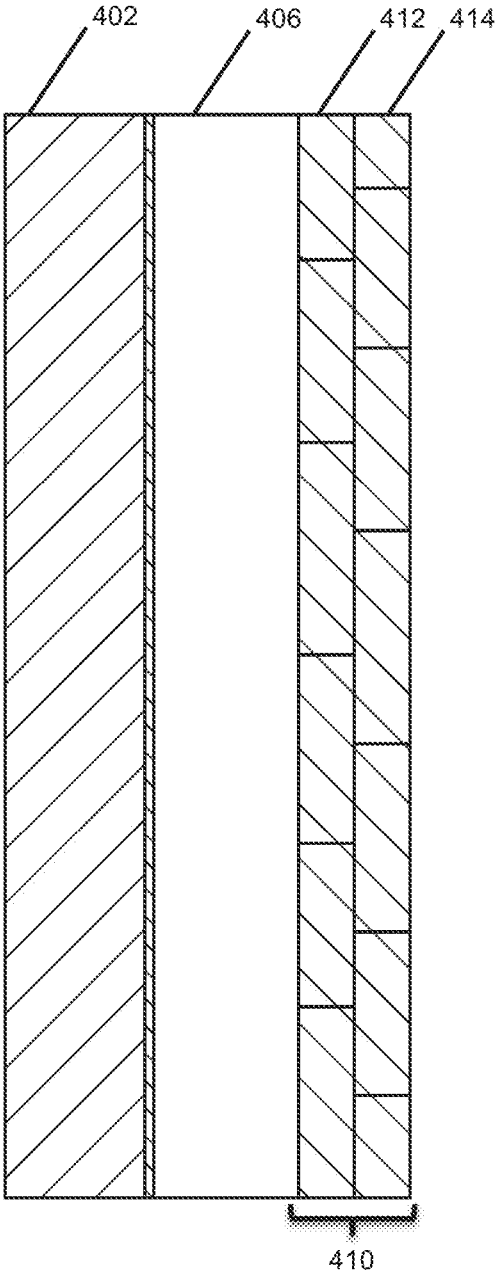
FIG. 9A shows a reinforced structural element having a sleeve structure with two segmented layers. The second layer has a half-height segment at each end, so that the horizontal seams of the first and second segmented layers are staggered by half the segment height.
Figure 9B:
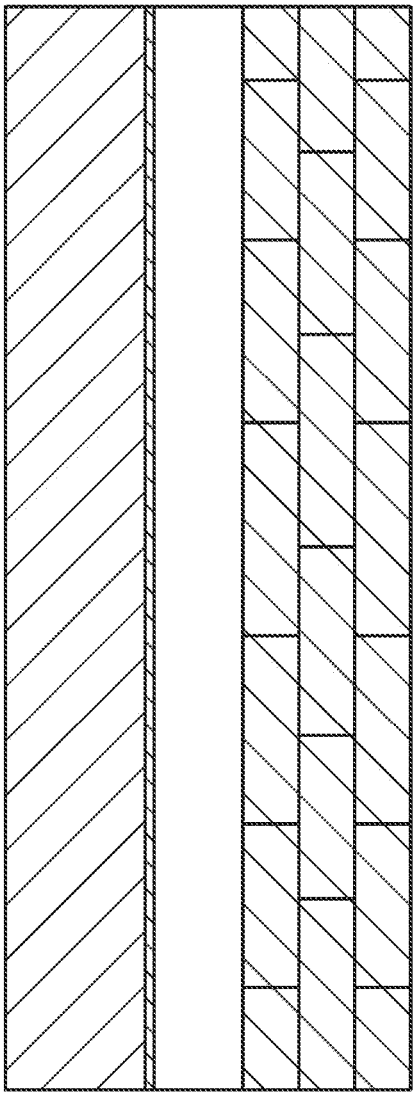
FIG. 9B shows a reinforced structural element having a sleeve structure with three segmented layers. The first and third layers have a half-height segment at each end, so that the horizontal seams of each adjacent layer are staggered by half the segment height. Alternatively, one-third and two-third height segments could be used at the ends such that each of the three layers had seams which were staggered from those of each other layer.
Figure 10:
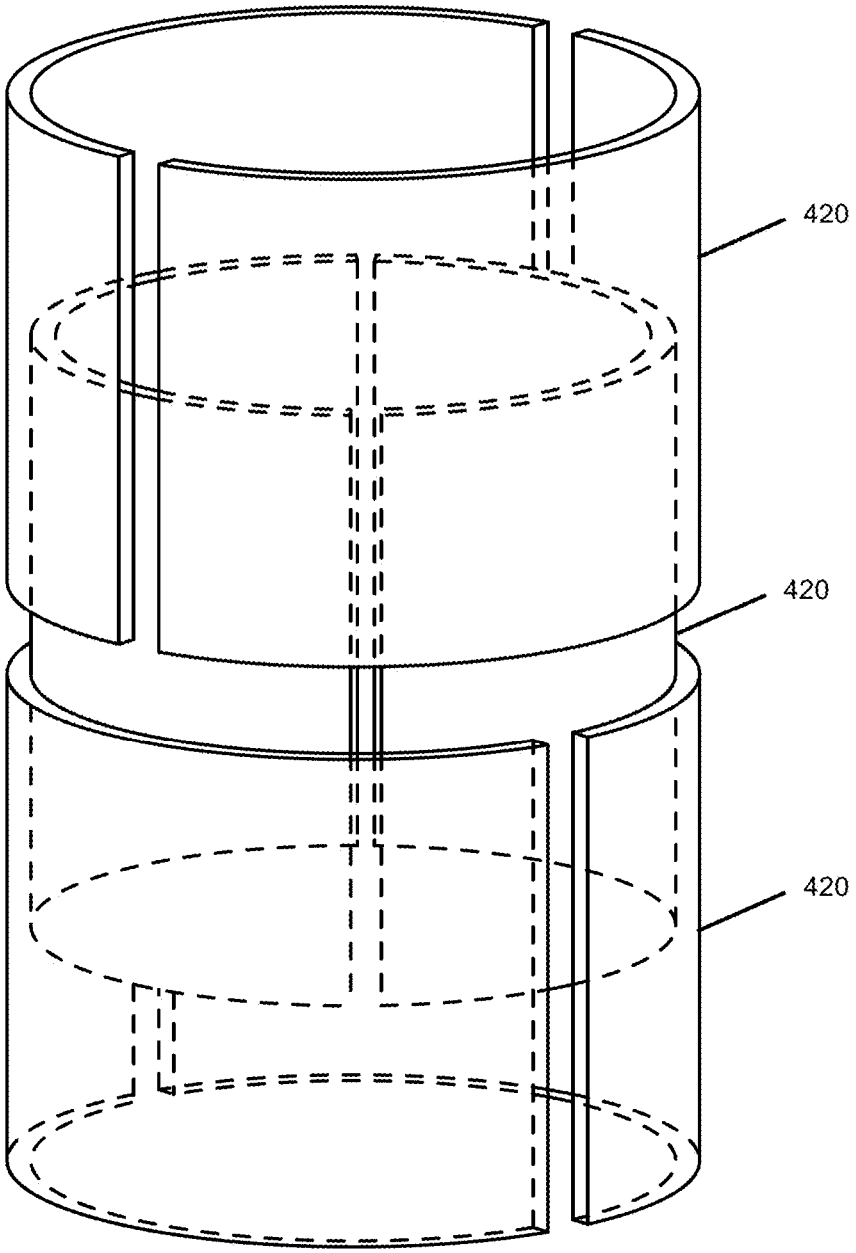
FIG. 10 shows that the vertical seams of each layer may additionally be staggered from the vertical seams of adjacent layers. The vertical seams of the two segments in the outer layer are staggered from each other by 90°. The vertical seams of the outer layer are additionally staggered by 45° from the vertical seams of the inner layer.
Figure 11A:
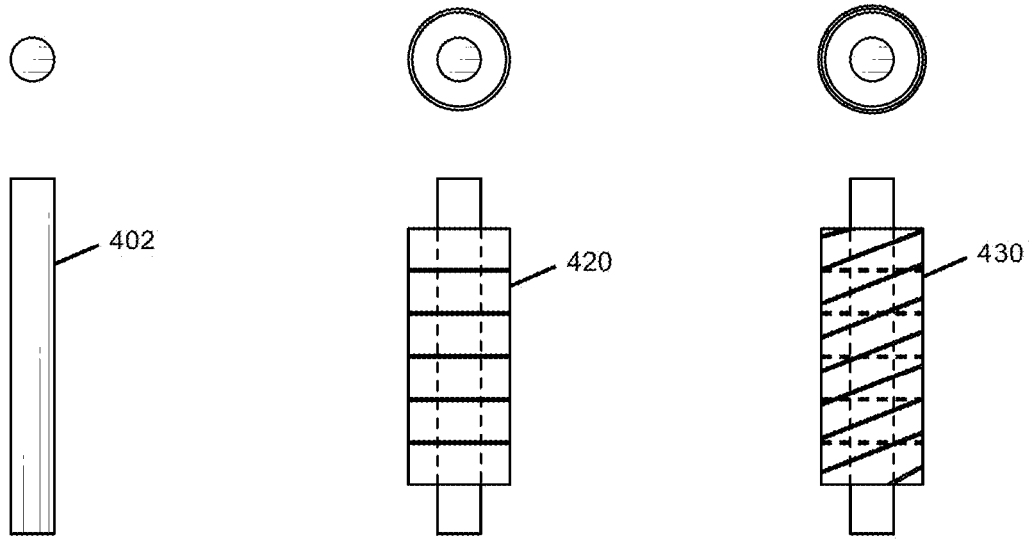
FIG. 11A shows a sequence for the reinforcement of a structural element. The left depicts the structural element alone. The center depicts the structural element with a surrounding sleeve structure formed of reinforcing shells. The right depicts the helical wrapping of the reinforcing shells with a flexible reinforcing material.
Figure 11B:
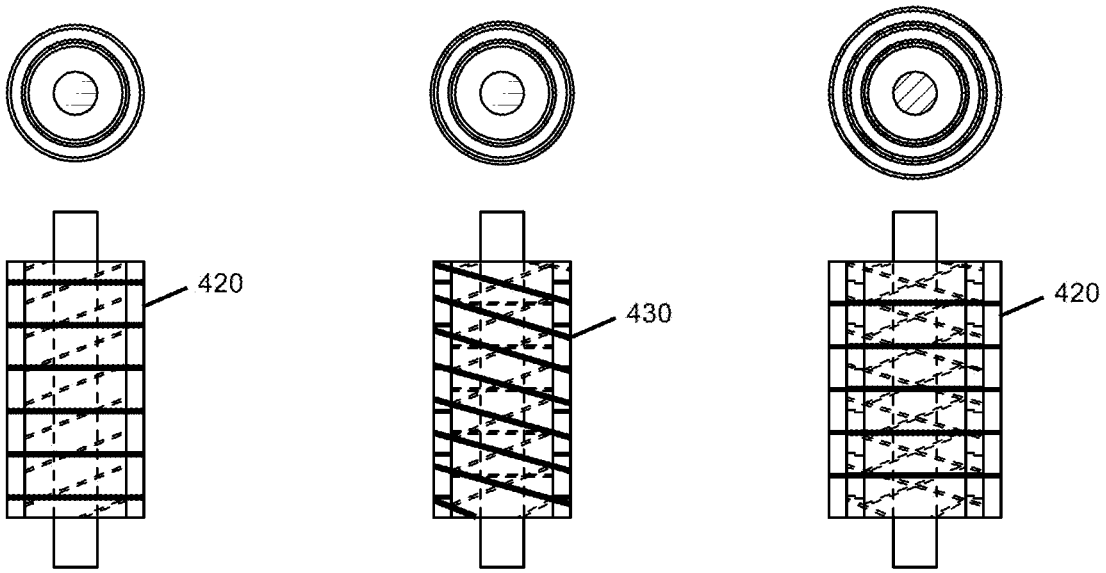
FIG. 11B shows a continued sequence for the reinforcement of the structural element of FIG. 11A. On the left, the sleeve structure is covered by an additional layer of reinforcing shells. In the center, the sleeve structure is covered by helical wrapping of the reinforcing shells with a flexible reinforcing material, where the wrapping is done in the opposite direction as in the first wrapped layer. On the right, the sleeve structure is covered by a third layer of reinforcing shells.
Figure 12:
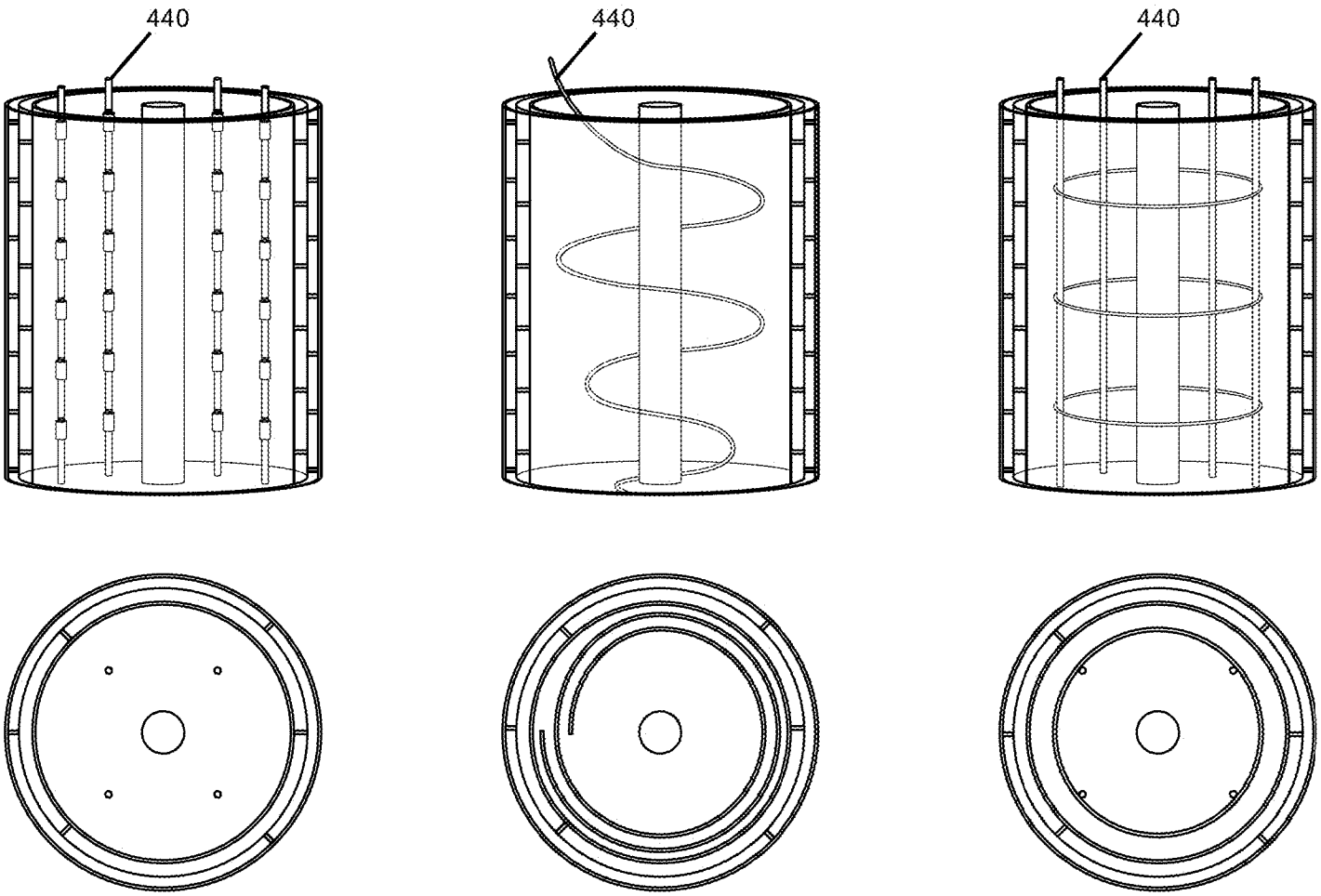
FIG. 12 shows examples of reinforced structural elements which include axial reinforcing members in the chamber between the sleeve structure and the structural element. On the left, the axial reinforcing members are vertical rods formed by coupled rebar segments. In the center, the axial reinforcing member is a helix which wraps around the structural element. On the right, the axial reinforcing members are vertical rods which are connected via circular reinforcing hoops.
Figure 13:
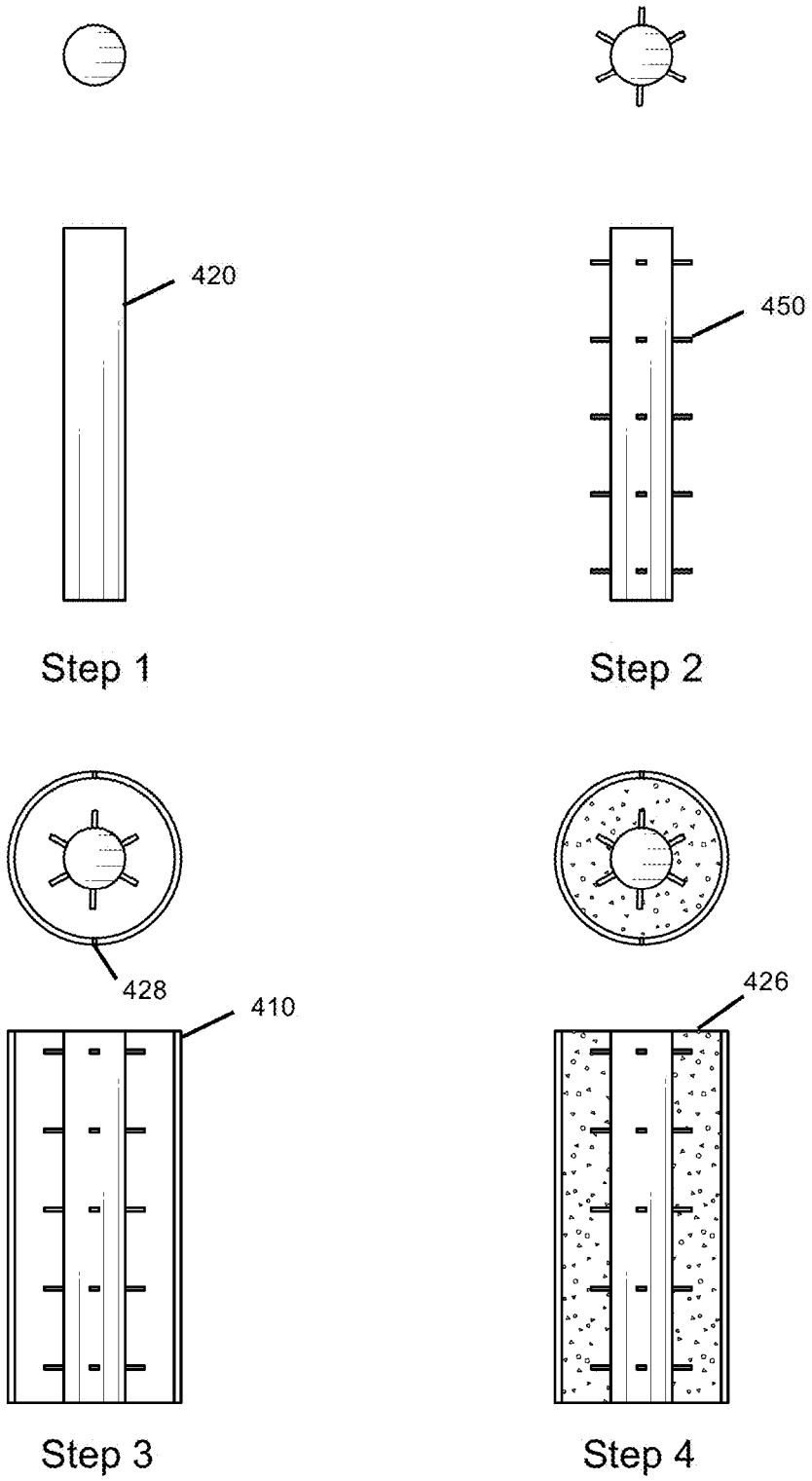
FIG. 13 shows a sequence for the reinforcement of a structural element. Step 1 shows the bare structural element. Step 2 shows the structural element with sheer keys drilled into the surface of the structural element. Step 3 shows the structural element surrounded by a sleeve structure. Step 4 shows the reinforced structural element with the chamber between the structural element and the sleeve structure filled with core filler material, which also encapsulates the sheer keys.
Figure 14:
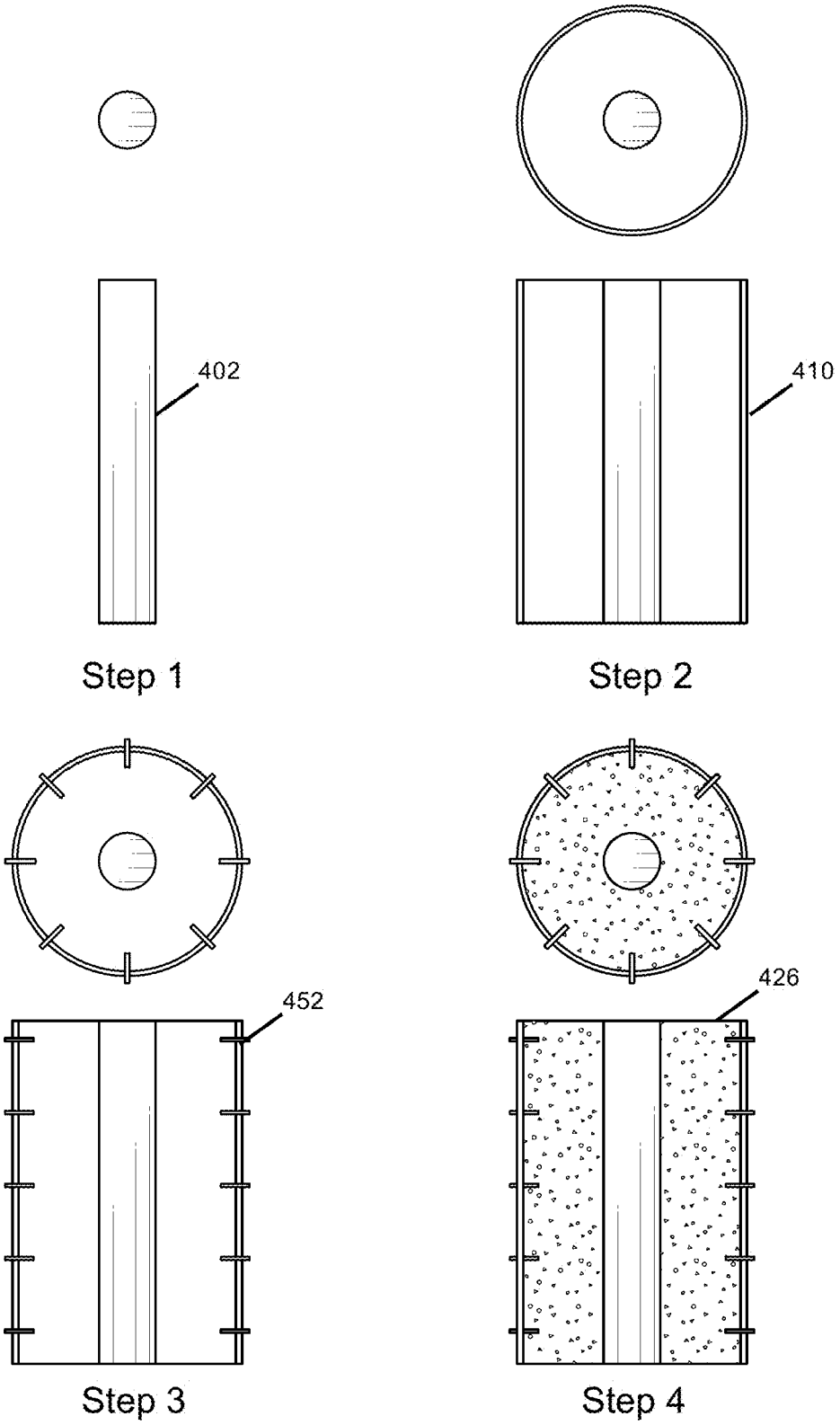
FIG. 14 shows a sequence for the reinforcement of a structural element. Step 1 shows the bare structural element. Step 2 shows the structural element surrounded by a sleeve structure. Step 3 shows the structural element with sheer key protrusions drilled into the sleeve structure. Step 4 shows the reinforced structural element with the chamber between the structural element and the sleeve structure filled with core filler material, which also encapsulates the sheer keys.
Figure 15A:
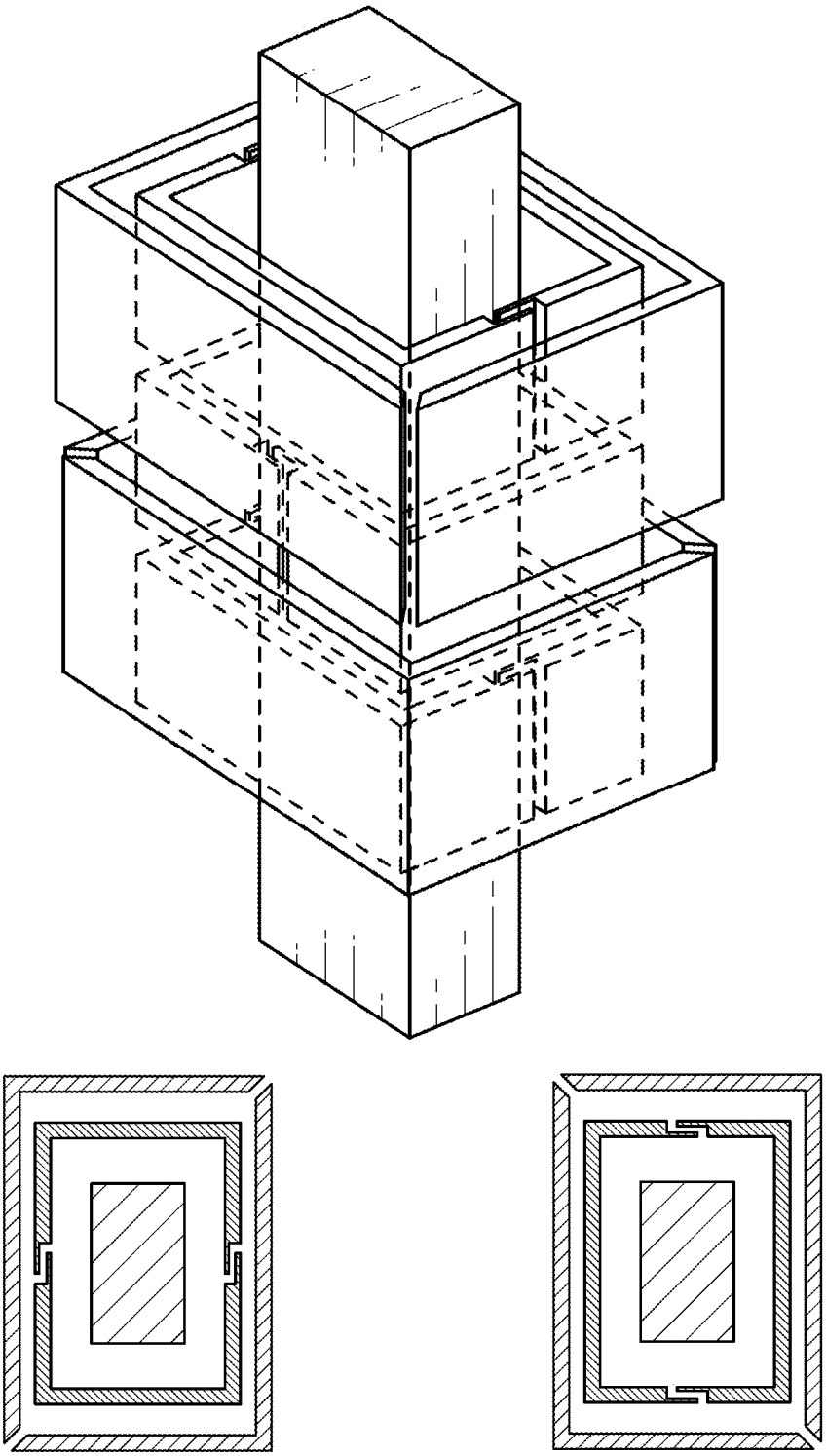
FIG. 15A shows the reinforcement of a rectangular structural element using a rectangular sleeve structure. The first layer of the rectangular sleeve structure has seams at the midpoint of the side of the rectangular sleeve structure and the second layer of the rectangular sleeve structure has seams at the corners of the rectangular sleeve structure. Note that the spacing between the first and second layers is not to scale, but rather expanded for clarity. These layers are in contact with only a thin layer of adhesive between them.
Figure 15B:
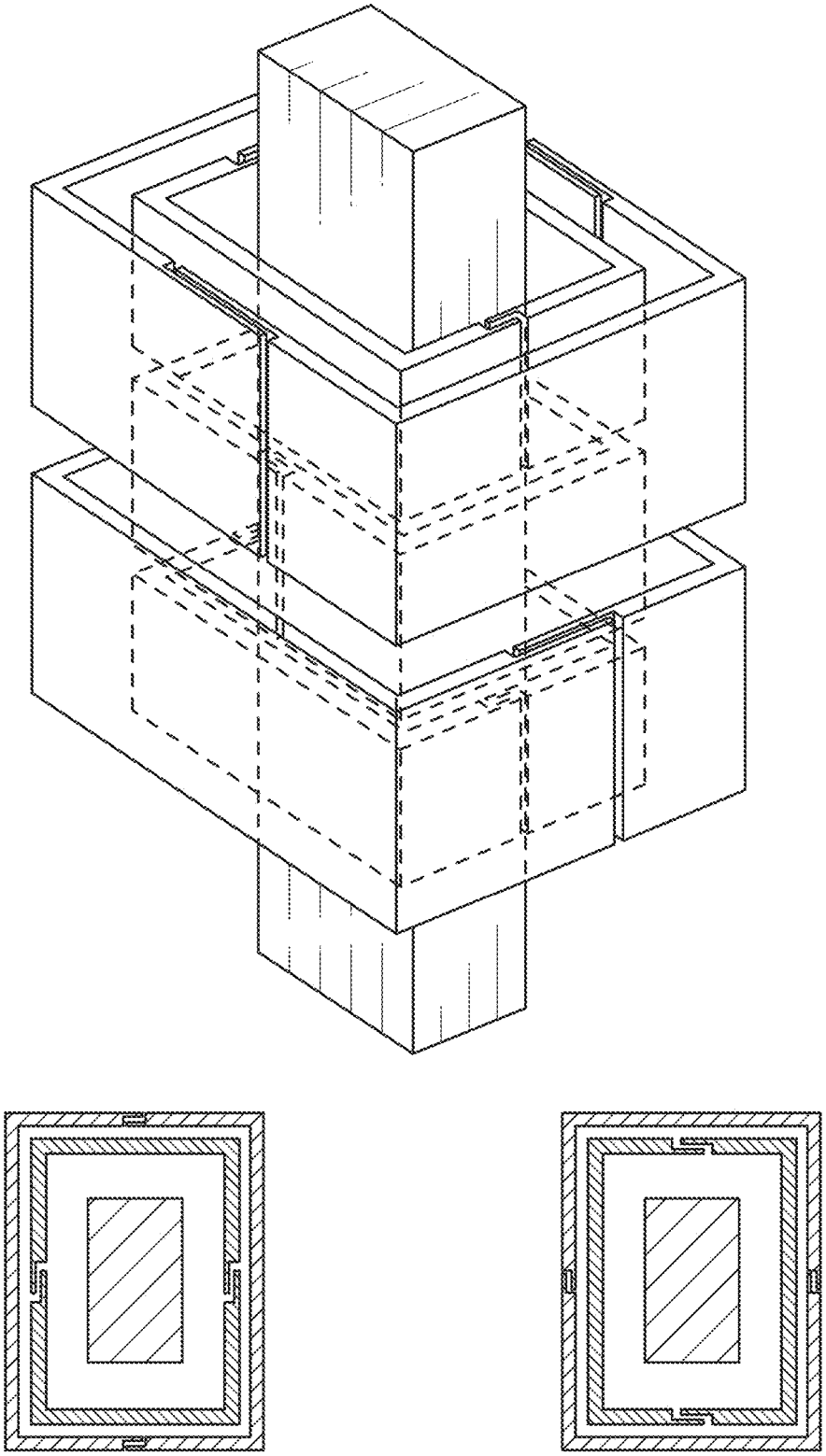
FIG. 15B shows the reinforcement of a rectangular structural element using a rectangular sleeve structure with seams at the midpoints of the sides in both the first layer and the second layer. Note that the spacing between the first and second layers is not to scale, but rather expanded for clarity. These layers are in contact with only a thin layer of adhesive between them.
Figure 16:
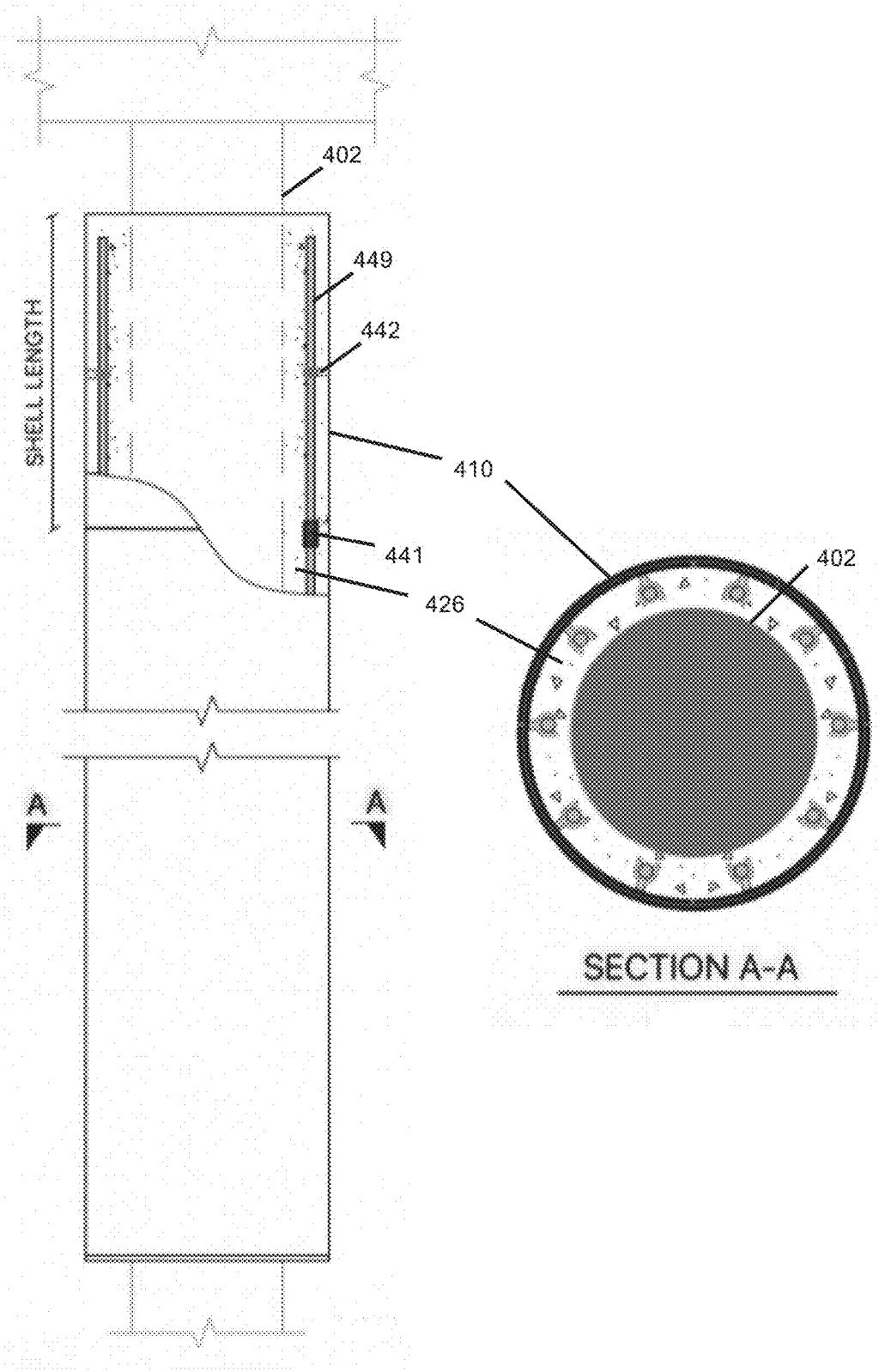
FIG. 16 shows a schematic illustration of the reinforcement of a structural element using a sleeve structure connected to rebar axial reinforcing members via snap-on axial reinforcing member spacers.
Figure 17A:
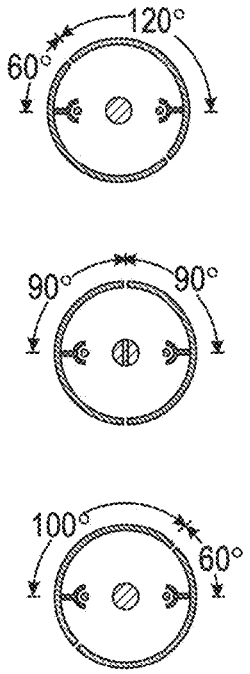
FIGS. 17A-17I show top-down view schematic illustrations of the attachment of sequential segments of a first segmented layer to axial reinforcing members via axial reinforcing member spacers. The angular distances from the axial reinforcing member spacers to the vertical seams are marked.
Figure 17B:
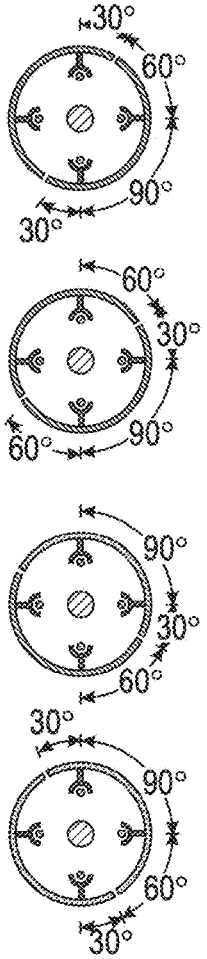
Figure 17C:
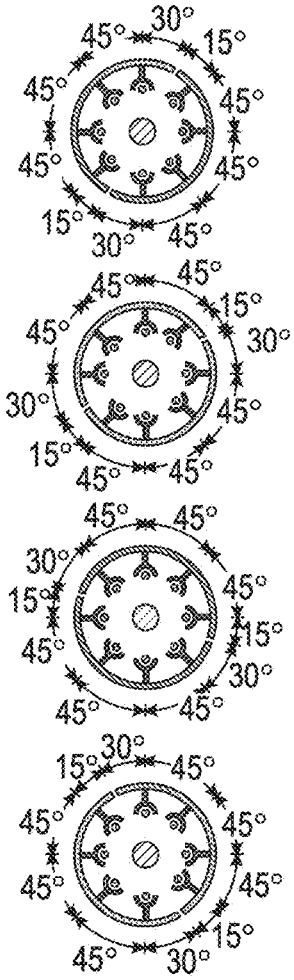
Figure 17D:
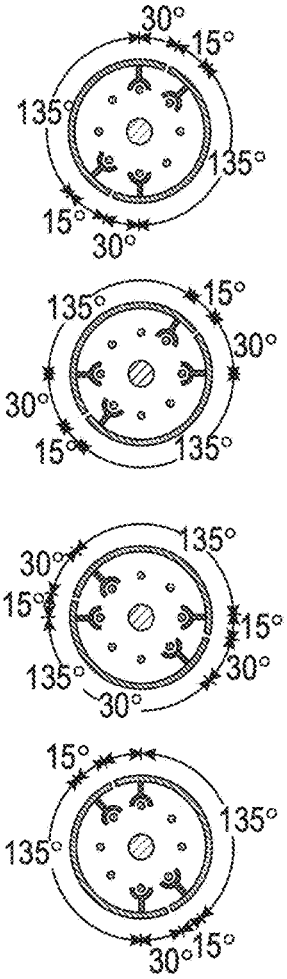
Figure 17E:
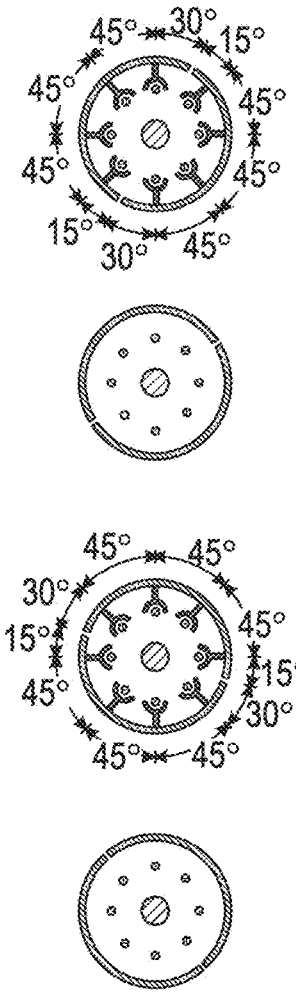
Figure 17F:
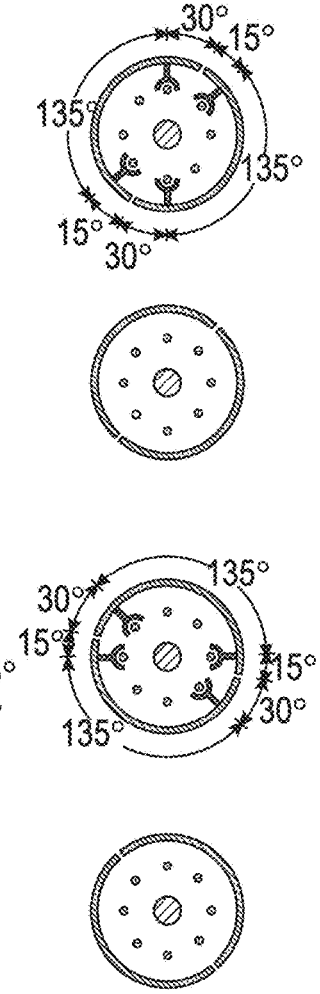
Figure 17H:
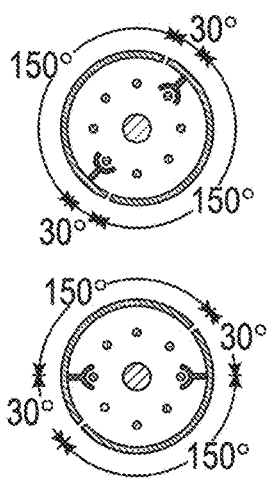
Figure 17H:
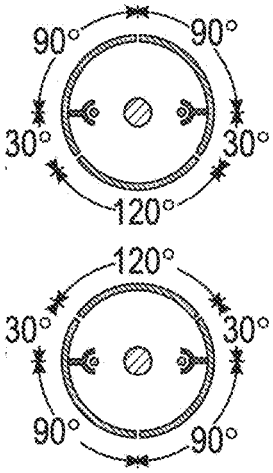
Figure 17G:
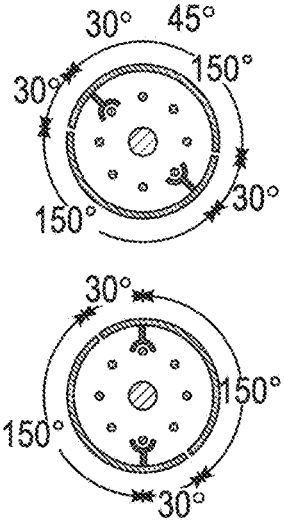
Figure 17I:
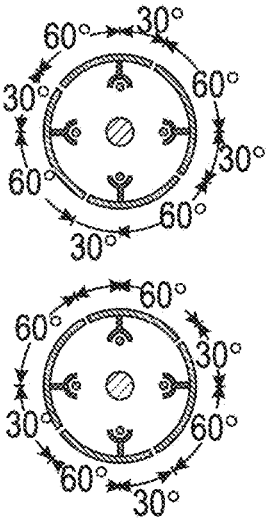
Figure 18:
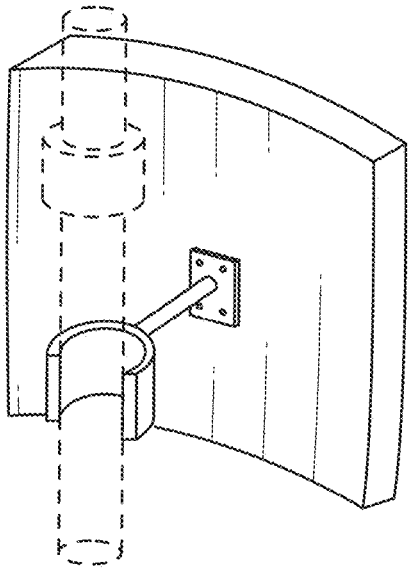
FIG. 18 shows a schematic illustration of an axial reinforcing member spacer attached to an interior surface of a reinforcing partial-diameter shell, the axial reinforcing member spacer attached to an axial reinforcing member via a u-shaped clip.
Figure 19:
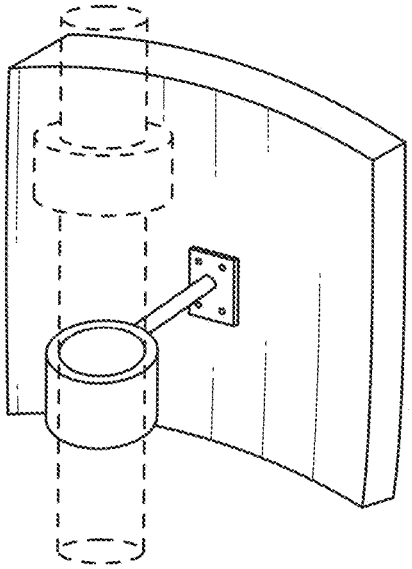
FIG. 19 shows a schematic illustration of an axial reinforcing member spacer attached to an interior surface of a reinforcing partial-diameter shell, the axial reinforcing member spacer attached to an axial reinforcing member via a rigid loop.
Figure 20:
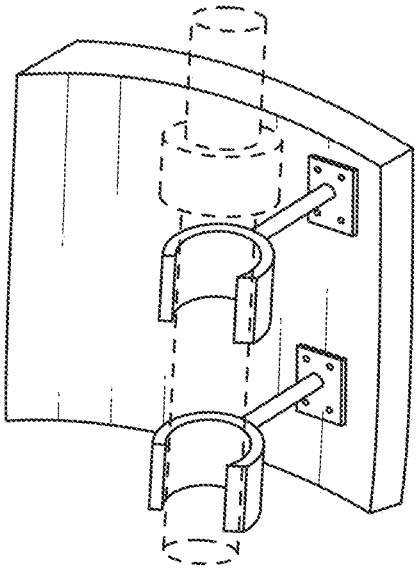
FIG. 20 shows a schematic illustration of two axial reinforcing member spacers attached to an interior surface of a reinforcing partial-diameter shell, the axial reinforcing member spacers aligned to attach to the same axial reinforcing member.
Figure 21:
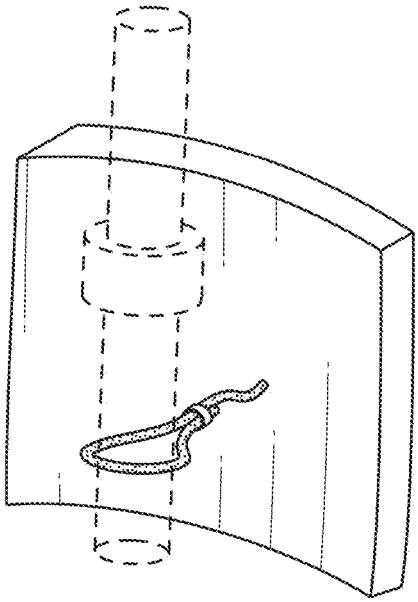
FIG. 21 shows a schematic illustration of an axial reinforcing member spacer attached to an interior surface of a reinforcing partial-diameter shell, the axial reinforcing member spacer attached to an axial reinforcing member via a flexible loop. Such flexible axial reinforcing member spacers may be especially suitable for use when the axial reinforcing members are connected to each other via circular reinforcing hoops, or by additional spacing clips.
Figure 22:
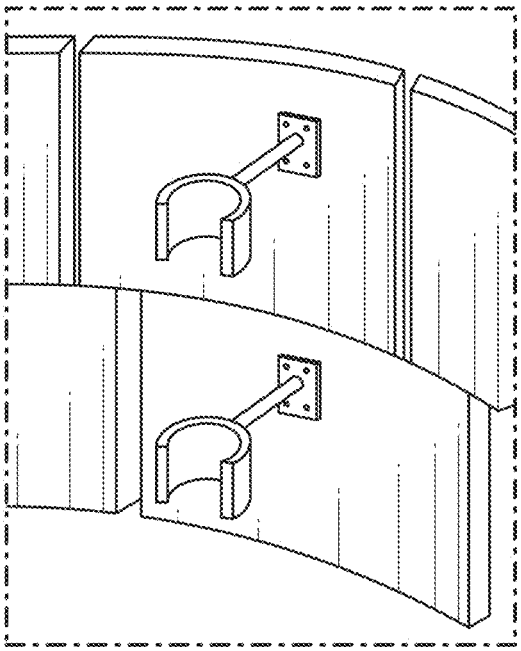
FIG. 22 shows a schematic illustration of two axial reinforcing member spacers attached to the interior surfaces of reinforcing partial-diameter shells of sequential segments, the axial reinforcing member spacers aligned to attach to the same axial reinforcing member.
Figure 23:
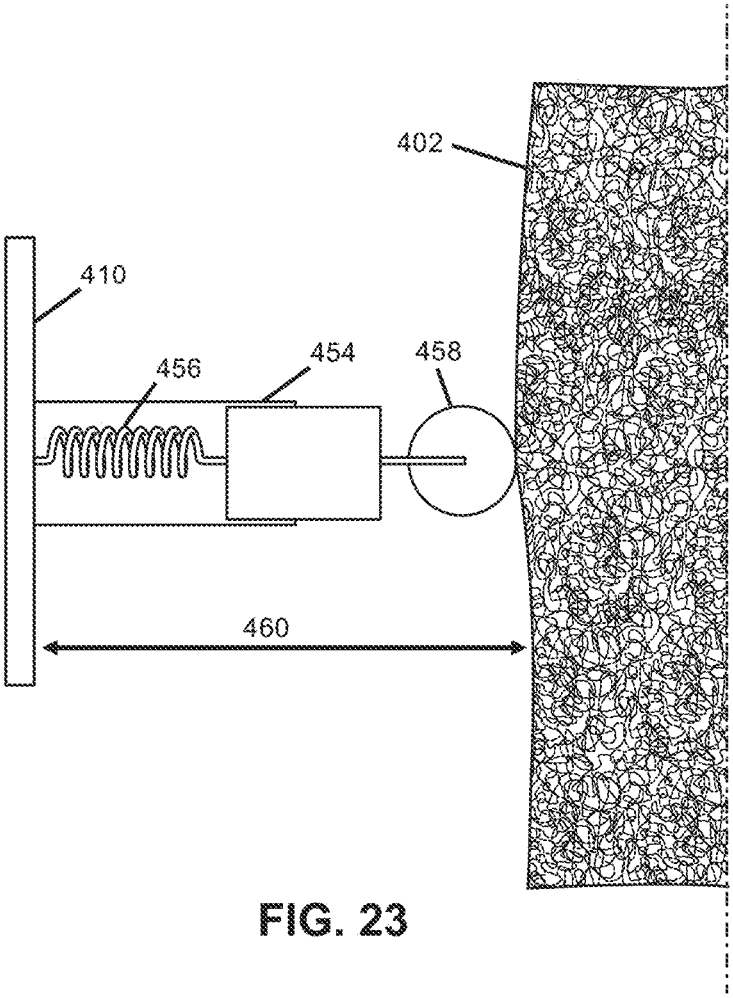
FIG. 23 shows a schematic illustration of a spring-loaded spacer with a roller for guiding a sleeve structure down around a structural element such that the annular space between the sleeve structure and the structural element remains uniform on all sides of the structural element.
Figure 24A:
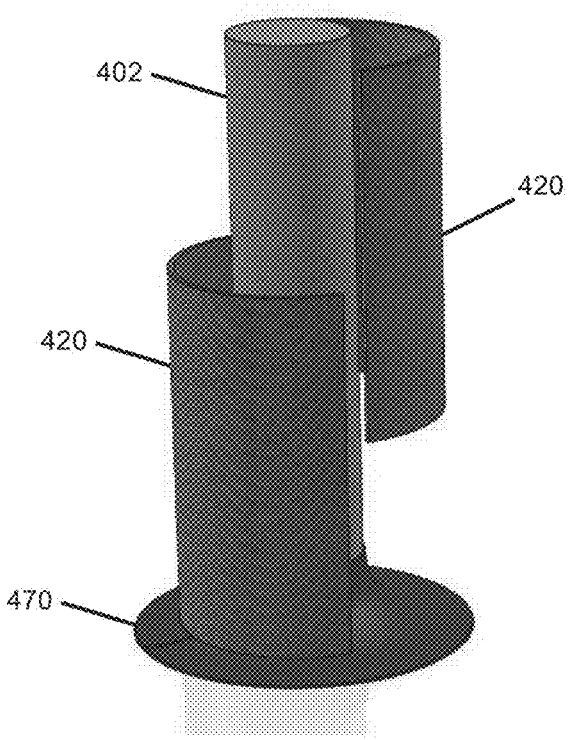
FIG. 24A shows a schematic illustration of the installation of multiple reinforcing shells and a bottom seal around a structural element, where the bottom seal is positioned around the structural element and the reinforcing shells are positioned on top of the bottom seal so as to form a sleeve structure.
Figure 24B:
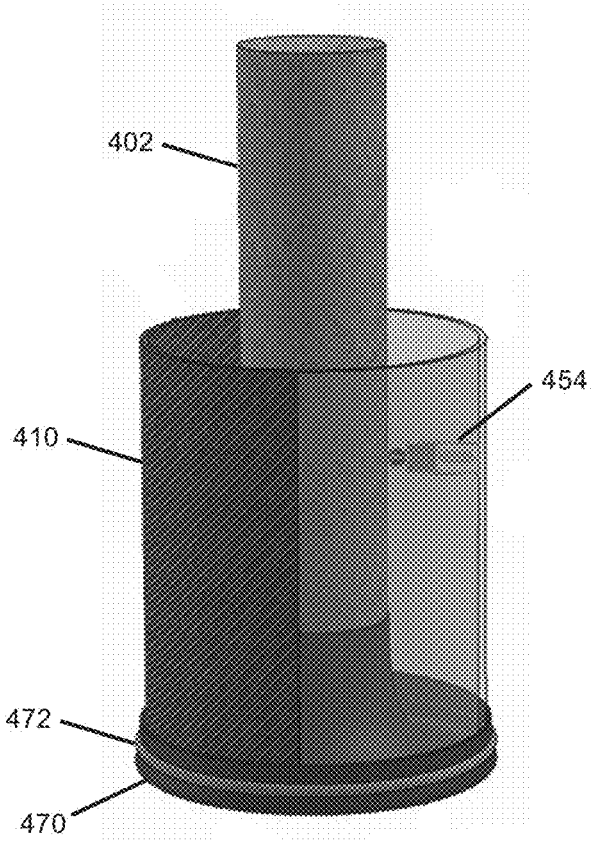
FIG. 24B shows a schematic illustration of the sleeve structure of FIG. 24A with the bottom seal fastened to the sleeve structure via a bottom seal fastener strap. Additionally, a spring-loaded spacer holds the sleeve structure in position around the structural element.

FIG. 6 shows a reinforced structural element 1 formed in accordance with the method exemplified with FIGS. 1-5. In particular, the reinforced structural element 1 comprises a structural element 2, the first pair of rigid, semi-rigid, or flexible fiber-reinforced shells 10, and the second pair of rigid, semi-rigid, or flexible fiber-reinforced shells 20. FIG. 6 also shows the first pair of rigid, semi-rigid, or flexible fiber-reinforced shells 10 disposed about the structural element 2, and the second pair of rigid, semi-rigid, or flexible fiber-reinforced shells 20 disposed about the first pair of rigid, semi-rigid, or flexible fiber-reinforced shells 10. The first pair of rigid, semi-rigid, or flexible fiber-reinforced shells 10 comprises the first rigid, semi-rigid, or flexible fiber-reinforced shell 12 and the second rigid, semi-rigid, or flexible fiber-reinforced shell 14, which are positioned to form the first seam 16 and the second seam 18 (not shown). The second pair of rigid, semi-rigid, or flexible fiber-reinforced shells 20 comprises the third rigid, semi-rigid, or flexible fiber-reinforced shell 22 and the fourth rigid, semi-rigid, or flexible fiber-reinforced shell 24, which are positioned to form the third seam 26 and the fourth seam (not shown).

The present invention further provides a reinforced structural element 1 formed by the method described above.

Typically, the reinforced structural element 1 has different physical properties than the structural element 2, such as an improved (e.g. an increased) loading capacity, structural efficiency, stiffness, compression strength, and/or shear strength, compared to the structural element. In another embodiment, for another purpose, the reinforced structural element may be protected against elements, corrosion, etc. without being stronger than the non-reinforced structural element. That is, the reinforcement of the present invention may be used as a protective layer to prevent damage, or as a reconstructive layer to repair damage.

The invention has been described in an illustrative manner, and it is to be understood that the terminology which has been used is intended to be in the nature of words of description rather than of limitation. Obviously, many modifications and variations of the present invention are possible in light of the above teachings. The invention may be practiced otherwise than as specifically described.

Likewise, it is also to be understood that the appended claims are not limited to express and particular compounds, compositions, or methods described in the detailed description, which may vary between particular embodiments that fall within the scope of the appended claims. With respect to any Markush groups relied upon herein for describing particular features or aspects of various embodiments, different, special, and/or unexpected results may be obtained from each member of the respective Markush group independent from all other Markush members. Each member of a Markush group may be relied upon individually and or in combination and provides adequate support for specific embodiments within the scope of the appended claims.

Further, any ranges and subranges relied upon in describing various embodiments of the present invention independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present invention, and such ranges and subranges may be further delineated into relevant halves, thirds, quarters, fifths, and so on. As just one example, a range "of from 0.1 to 0.9" may be further delineated into a lower third, i.e., from 0.1 to 0.3, a middle third, i.e., from 0.4 to 0.6, and an upper third, i.e., from 0.7 to 0.9, which individually and collectively are within the scope of the appended claims, and may be relied upon individually and/or collectively and provide adequate support for specific embodiments within the scope of the appended claims. In addition, with respect to the language which defines or modifies a range, such as "at least," "greater than," "less than," "no more than," and the like, it is to be understood that such language includes subranges and/or an upper or lower limit. As another example, a range of "at least 10" inherently includes a subrange of from at least 10 to 35, a subrange of from at least 10 to 25, a subrange of from 25 to 35, and so on, and each subrange may be relied upon individually and/or collectively and provides adequate support for specific embodiments within the scope of the appended claims. Finally, an individual number within a disclosed range may be relied upon and provides adequate support for specific embodiments within the scope of the appended claims. For example, a range "of from 1 to 9" includes various individual integers, such as 3, as well as individual numbers including a decimal point (or fraction), such as 4.1, which may be relied upon and provide adequate support for specific embodiments within the scope of the appended claims.

As used herein, the term "about" refers to plus or minus 10% of the referenced number.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting essentially of" or "consisting of", and as such the written description requirement for claiming one or more embodiments of the present invention using the phrase "consisting essentially of" or "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A system for reinforcing a structural element (402), comprising:

a. a plurality of reinforcing shells (420) configured to form a sleeve structure (410) around a length (405) of the structural element (402) such that there is a chamber (406) between the structural element (402) and the sleeve structure (410), wherein the sleeve structure (410) comprises:

i. a first segmented layer (412), comprising a plurality of stacked segments (416) and a plurality of horizontal seams (418) between the segments (416), the segments (416) disposed along an axis (404), wherein each segment (416) comprises two or more rigid or semi-rigid reinforcing partial-diameter shells (420) and two or more vertical seams (424) between the rigid or semi-rigid reinforcing partial-diameter shells (420); and b. a plurality of axial reinforcing members (440) configured to be disposed within the chamber (406) so as to provide axial reinforcement of the structural element (402);

c. a plurality of axial reinforcing member spacers (442) configured to extend inwardly from the sleeve structure (410) into the chamber (406) and to connect the axial reinforcing members (440) to the sleeve structure (410); and d. a core filler material (426) configured to fill the chamber (406) between the sleeve structure (410) and the structural element (402) so as to reinforce the structural element (402).

2. The system of claim 1, wherein the plurality of axial reinforcing members (440) comprises N axial reinforcing members, disposed around the structural element (402) about every 360/N degrees.

3. The system of claim 1, wherein each of the plurality of axial reinforcing members (440) are segmented.

4. The system of claim 3, wherein a segment of the axial reinforcing members (440) has a length of about equal to a height of an integer number of the plurality of stacked segments (416).

5. The system of claim 3, wherein the segments of the axial reinforcing members (440) are vertically staggered.

6. The system of claim 1, additionally comprising a plurality of spacers (454) attached to inner surfaces of the reinforcing partial-diameter shells (420) so as to hold the sleeve structure (410) in a desired orientation around the structural element (402).

7. The system of claim 1, wherein the axial reinforcing members (440) are configured to support the sleeve structure (410) as it is lowered around the structural element (402).

8. The system of claim 1, additionally comprising a bottom seal (470) configured to be attached to a bottom segment of the sleeve structure (410) via a bottom seal fastener (472) so as to prevent the core filler material (426) from leaking out of the chamber (406).

9. The system of claim 1, wherein each of the plurality of axial reinforcing member spacers (442) is attached to an interior surface of one of the rigid or semi-rigid reinforcing partial-diameter shells (420).

10. The system of claim 9, wherein each of the plurality of axial reinforcing member spacers (442) is attached to an interior surface of one of the rigid or semi-rigid reinforcing partial-diameter shells (420) via an adhesive.

11. The system of claim 1, wherein each of the plurality of axial reinforcing member spacers (442) is attached to an interior surface of one of the rigid or semi-rigid reinforcing partial-diameter shells (420) at an angular distance from the vertical seams (424).

12. The system of claim 1, wherein the axial reinforcing members (440) are vertical rods which are connected via circular reinforcing hoops.

13. The system of claim 1, wherein each stacked segment (416) of the first segmented layer (412) is connected to one or more of the axial reinforcing members (440) via one or more axial reinforcing member spacers (442).

14. The system of claim 1, wherein the connection between the axial reinforcing member spacers (442) and the axial reinforcing members (440) is such that the axial reinforcing member spacers (442) may slide along the axial reinforcing members (440).

15. The system of claim 1, wherein the axial reinforcing member spacers (442) are rigid, and configured to hold the axial reinforcing members (440) at a spacer distance from an interior surface of one of the rigid or semi-rigid reinforcing partial-diameter shells (420).

16. A system for reinforcing a structural element (402), comprising:

a. a sleeve structure (410) comprising a plurality of reinforcing shells (420), configured to surround a length (405) of the structural element (402) such that there is a chamber (406) between the structural element (402) and the sleeve structure (410), wherein the sleeve structure (410) comprises:

i. one or more stacked segments (416), the segments (416) disposed along an axis (404), wherein each segment (416) comprises two or more rigid or semi-rigid reinforcing partial-diameter shells (420) and two or more vertical seams (424) between the rigid or semi-rigid reinforcing partial-diameter shells (420);

b. a plurality of segmented axial reinforcing members (440) configured to be connected to the sleeve structure (410) so as to provide axial reinforcement of the structural element (402); and c. a core filler material (426) configured to fill the chamber (406) between the sleeve structure (410) and the structural element (402) so as to reinforce the structural element (402).

17. The system of claim 16, wherein the sleeve structure (410) and the plurality of axial reinforcing members (440) are configured to be lowered relative to the structural element (402).

18. A system for reinforcing a structural element (402), comprising:

a. a plurality of reinforcing shells (420) configured to form a sleeve structure (410) around a length (405) of the structural element (402) such that there is a chamber (406) between the structural element (402) and the sleeve structure (410), wherein the sleeve structure (410) comprises:

i. a first segmented layer (412), comprising a plurality of stacked segments (416) and a plurality of horizontal seams (418) between the segments (416), the segments (416) disposed along an axis (404), wherein each segment (416) comprises two or more rigid or semi-rigid reinforcing partial-diameter shells (420) and two or more vertical seams (424) between the rigid or semi-rigid reinforcing partial-diameter shells (420); and ii. one or more wrapped layers (430), each wrapped layer (430) formed by wrapping a flexible reinforcing material around one of the segmented layers or another of the wrapped layers (430); and b. a core filler material (426) configured to fill the chamber (406) between the sleeve structure (410) and the structural element (402) so as to reinforce the structural element (402).

19. The system of claim 18, wherein a first wrapped layer (430) and a second wrapped layer (430) are wrapped in opposite directions so as to produce a crossed pattern.

20. The system of claim 18, additionally comprising:

a. a plurality of axial reinforcing members (440) configured to be disposed within the chamber (406) so as to provide axial reinforcement of the structural element (402); and b. a plurality of axial reinforcing member spacers (442) configured to extend inwardly from the sleeve structure (410) into the chamber (406) and to connect the axial reinforcing members (440) to the sleeve structure (410).

* * * * *